US011673398B2

(12) United States Patent
Oya et al.

(10) Patent No.: US 11,673,398 B2
(45) Date of Patent: Jun. 13, 2023

(54) CARTRIDGE, PRINTING SYSTEM, AND PRINTING DEVICE

(71) Applicant: SEIKO EPSON CORPORATION, Tokyo (JP)

(72) Inventors: Shun Oya, Kiso-machi (JP); Yoshihiro Koizumi, Shiojiri (JP); Takumi Nagashima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 60 days.

(21) Appl. No.: 17/483,997

(22) Filed: Sep. 24, 2021

(65) Prior Publication Data

US 2022/0097389 A1 Mar. 31, 2022

(30) Foreign Application Priority Data

Sep. 25, 2020 (JP) ..... JP2020-160618

(51) Int. Cl.
*B41J 2/175* (2006.01)

(52) U.S. Cl.
CPC ..... *B41J 2/1753* (2013.01); *B41J 2/1752* (2013.01)

(58) Field of Classification Search
CPC .... B41J 2/1753; B41J 2/1752; B41J 2/17513; B41J 2/17523; B41J 2/17526; B41J 2/17553; B41J 2/17503
USPC ..... 347/86
See application file for complete search history.

(56) References Cited

U.S. PATENT DOCUMENTS

| | | | | |
|---|---|---|---|---|
| 8,616,686 | B2 | 12/2013 | Takagi et al. | |
| 2013/0182051 | A1* | 7/2013 | Aoki | B41J 2/175 347/85 |
| 2014/0009539 | A1* | 1/2014 | Nozawa | B41J 2/1753 347/86 |
| 2020/0238719 | A1 | 7/2020 | Oya et al. | |

FOREIGN PATENT DOCUMENTS

| | | | |
|---|---|---|---|
| EP | 2727733 | A1 | 5/2014 |
| EP | 3300900 | A1 | 4/2018 |
| EP | 3498478 | A1 | 6/2019 |
| JP | 2013-129175 | A | 7/2013 |

* cited by examiner

*Primary Examiner* — Matthew Luu
*Assistant Examiner* — Alexander D Shenderov
(74) *Attorney, Agent, or Firm* — Oliff PLC

(57) ABSTRACT

A cartridge includes a cartridge side terminal electrically coupled to a device side terminal, a liquid supply portion that is coupled to a liquid introduction portion and that makes a liquid flow to the liquid introduction portion, a terminal positioning portion that performs positioning by receiving a device side terminal positioning portion to regulate movement of the cartridge side terminal with respect to the device side terminal, and a supply portion positioning portion that performs positioning by receiving a device side supply portion positioning portion to regulate movement of the liquid supply portion with respect to the liquid introduction portion. A first direction is a direction intersecting a second direction, the first direction being a direction in which the terminal positioning portion extends, the second direction being a direction in which the supply portion positioning portion extends.

10 Claims, 23 Drawing Sheets

CARTRIDGE, PRINTING SYSTEM, AND PRINTING DEVICE

The present application is based on, and claims priority from JP Application Serial Number 2020-160618, filed Sep. 25, 2020, the disclosure of which is hereby incorporated by reference herein in its entirety.

BACKGROUND

1. Technical Field

The present disclosure relates to a technology for a cartridge, a printing system, and a printing device.

2. Related Art

In the related art, a technology for a cartridge including a liquid supply portion and a cartridge terminal has been known (JP-A-2013-129175).

Here, the liquid supply portion is coupled to a liquid introduction portion of a printing device, and the cartridge terminal comes into contact with a device side terminal of the printing device to be electrically coupled to each other. However, when the cartridge is mounted in the printing device, locations of the liquid supply portion and the liquid introduction portion or locations of the cartridge terminal and the device side terminal may be deviated from each other.

SUMMARY

According to a first aspect of the present disclosure, there is provided a cartridge detachably mounted in a cartridge mounting portion of a printing device including a liquid introduction portion that receives a liquid, a device side terminal, a device side terminal positioning portion, and a device side supply portion positioning portion. The cartridge includes a cartridge side terminal electrically coupled to the device side terminal, a liquid supply portion that is coupled to the liquid introduction portion and that makes the liquid flow to the liquid introduction portion, a terminal positioning portion that performs positioning by receiving the device side terminal positioning portion to regulate movement of the cartridge side terminal with respect to the device side terminal, and a supply portion positioning portion that performs positioning by receiving the device side supply portion positioning portion to regulate movement of the liquid supply portion with respect to the liquid introduction portion. A first direction is a direction intersecting a second direction, the first direction being a direction in which the terminal positioning portion extends, the second direction being a direction in which the supply portion positioning portion extends.

According to a second aspect of the present disclosure, there is provided a printing system. The printing system includes a printing device that includes a cartridge mounting portion; and the cartridge according to the above aspect.

According to a third aspect of the present disclosure, there is provided a printing device mounted with a cartridge including a cartridge side terminal, a liquid supply portion, a terminal positioning portion, and a supply portion positioning portion. The printing device includes a cartridge mounting portion that forms an accommodation chamber accommodating the cartridge and that has a support member supporting the cartridge. The cartridge mounting portion includes a liquid introduction portion coupled to the liquid supply portion, a device side terminal electrically coupled to the cartridge side terminal, a device side terminal positioning portion that performs positioning by being received by the terminal positioning portion to regulate movement of the cartridge side terminal with respect to the device side terminal, and a device side supply portion positioning portion that performs positioning by being received by the supply portion positioning portion to regulate movement of the liquid supply portion with respect to the liquid introduction portion, and a device first direction is a direction intersecting a device second direction, the device first direction being a direction in which the device side terminal positioning portion extends, the device second direction being a direction in which the device side supply portion positioning portion extends.

DESCRIPTION OF EXEMPLARY EMBODIMENTS

A. Embodiment

A-1. Configuration of Printing System

Figure 1:
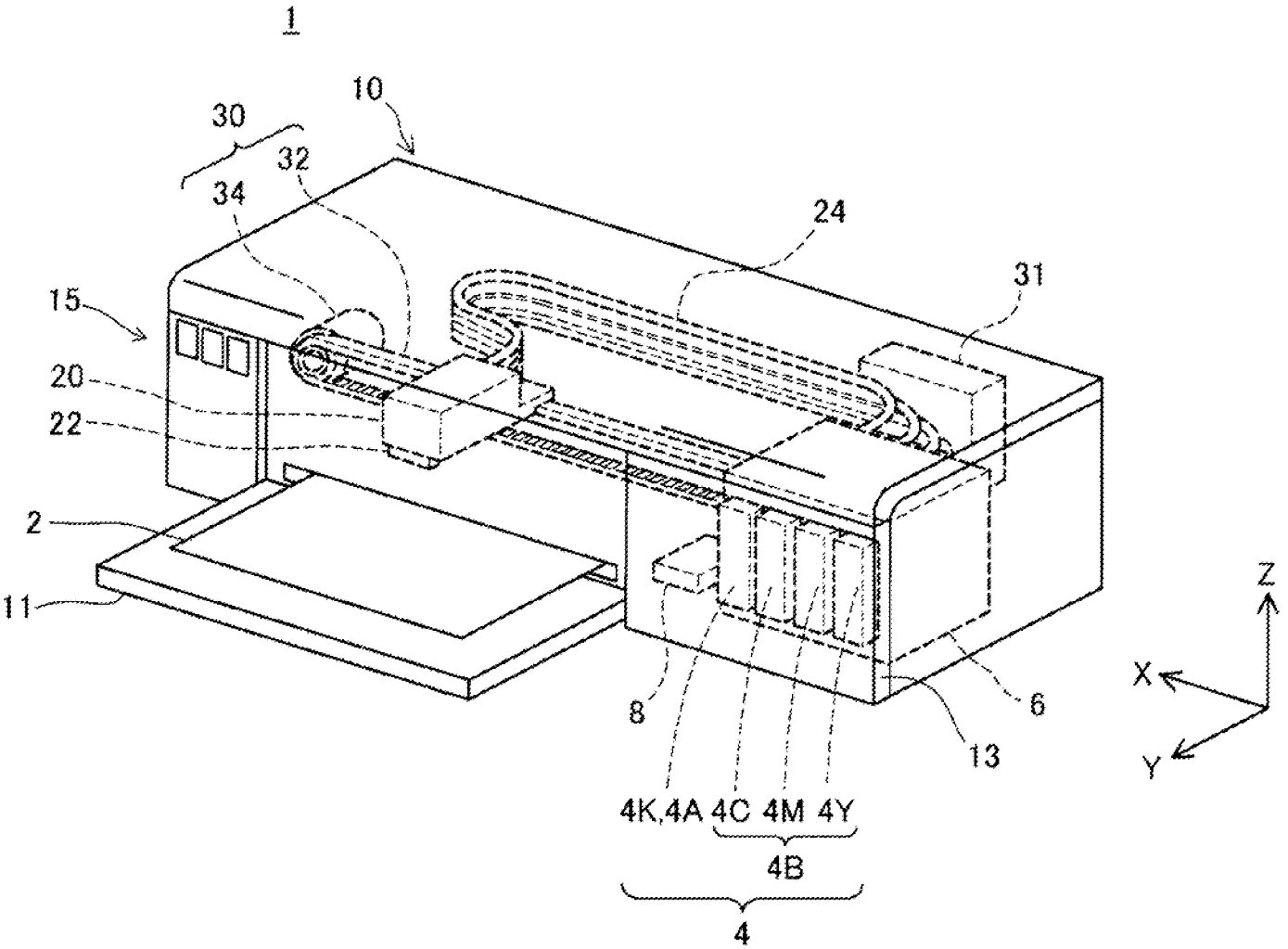
FIG. 1 is a perspective view illustrating a configuration of a printing system as an embodiment of the present disclosure.

FIG. 1 is a perspective view illustrating a configuration of a printing system 1 as an embodiment of the present disclosure. In FIG. 1, XYZ axes, which are three spatial axes orthogonal to each other, are drawn. Directions toward which arrows of the X axis, the Y axis, and the Z axis point are positive directions along the X axis, the Y axis, and the Z axis, respectively. The positive directions along the X axis, the Y axis, and the Z axis are a +X direction, a +Y direction, and a +Z direction, respectively. Directions opposite to the directions toward which the arrows of the X axis, the Y axis, and the Z axis point are negative directions along the X axis, the Y axis, and the Z axis, respectively. The negative directions along the X axis, the Y axis, and the Z axis are a −X direction, a −Y direction, and a −Z direction, respectively. When it is not necessary to distinguish positive and negative directions, the directions along the X axis, the Y axis, and the Z axis are referred to as an X direction, a Y direction, and a Z direction, respectively. The same applies to drawings and a description shown below.

The printing system 1 includes a printing device 10 and a cartridge 4 that supplies ink, which is a liquid, to the printing device 10.

The printing device 10 of the present embodiment is an ink jet printer that ejects ink from an ejection head 22. The printing device 10 is a large printer that performs printing on large sheets (A2 to A0 and the like) such as a poster. The printing device 10 includes a cartridge mounting portion 6, a control portion 31, a carriage 20, the ejection head 22, and a drive mechanism 30. In addition, the printing device 10 includes an operation button 15 for a user to operate the printing device 10.

A plurality of cartridges 4 are separately and detachably mounted in the cartridge mounting portion 6. In the present embodiment, four types of cartridges 4 corresponding to inks of four colors of black, yellow, magenta, and cyan, that is, four cartridges 4 in total are mounted in the cartridge mounting portion 6. A cartridge 4 containing black ink is also referred to as a cartridge 4K, a cartridge 4 containing yellow ink is also referred to as a cartridge 4Y, a cartridge 4 containing magenta ink is also referred to as a cartridge 4M, and a cartridge 4 containing cyan ink is also referred to as a cartridge 4C. In the present embodiment, the cartridge 4K is configured to be able to contain a more liquid than the cartridges 4C, 4M, and 4Y. Therefore, the cartridge 4K is also referred to as a first type of cartridge 4A, and the cartridges 4C, 4M, and 4Y are also referred to as a second type of cartridge 4B.

The printing device 10 includes a replacement cover 13 on a front surface on a +Y direction side. When a +Z direction side of the replacement cover 13 is tilted toward a front side which is the +Y direction side, an opening of the cartridge mounting portion 6 appears and attachment and detachment of the cartridge 4 is possible. When the cartridge 4 is mounted in the cartridge mounting portion 6, ink can be supplied to the ejection head 22 provided on the carriage 20 via tubes 24 as liquid flow pipes. In the present embodiment, for example, the ink is supplied to the ejection head 22 by a head difference between a liquid level of the ink in a liquid storage portion 699 and the ejection head 22. Note that in another embodiment, the ink may be supplied to the ejection head 22 by a head difference between a liquid level in the cartridge 4 and the ejection head 22 or may be supplied to the ejection head 22 by a pump mechanism (not illustrated) of the printing device 10 sucking the ink in the cartridge 4. Note that the tubes 24 are provided for the respective types of ink. Note that a state in which the cartridge 4 is mounted in the cartridge mounting portion 6 and the ink as the liquid can be supplied to the printing device 10 is also referred to as a "mounted state".

The ejection head 22 is provided with nozzles for each type of ink. The ejection head 22 ejects the ink from the nozzles toward a printing sheet 2 to print data such as characters or images. Note that a state of mounting the cartridge 4 in the cartridge mounting portion 6 or detailed configurations of the cartridge 4 and the cartridge mounting portion 6 will be described later. Note that in the present embodiment, the printing device 10 is a so-called "off-carriage type" printer in which the cartridge mounting portion 6 does not move together with the carriage 20. The present disclosure can also be applied to a so-called "on-carriage type" printer in which the cartridge mounting portion 6 is provided on the carriage 20 and moves together with the carriage 20.

The control portion 31 controls each portion of the printing device 10 or transmission and reception of a signal to and from the cartridge 4. The carriage 20 moves the ejection head 22 relative to the printing sheet 2.

The drive mechanism 30 reciprocates the carriage based on a control signal from the control portion 31. The drive mechanism 30 includes a timing belt 32 and a drive motor 34. By transmitting power of the drive motor 34 to the carriage 20 via the timing belt 32, the carriage 20 reciprocates in a main scanning direction, which is a direction along the X direction. In addition, the printing device 10 includes a transport mechanism for moving the printing sheet 2 in a sub-scanning direction, which is the +Y direction. When printing is performed, the printing sheet 2 is moved in the sub-scanning direction by the transport mechanism, and the printing sheet 2 after printing is completed is discharged onto a front cover 11.

In addition, a region referred to as a home location is included at a location outside a printing region where the carriage 20 is moved in the main scanning direction, and a maintenance mechanism that performs maintenance for normally executing the printing is mounted at the home location. The maintenance mechanism includes a cap member 8 that is pressed against a surface, on which the nozzles are formed, on a bottom surface side of the ejection head 22 to form a closed space so as to surround the nozzles, an elevating and lowering mechanism (not illustrated) that elevates and lowers the cap member 8 in order to press the cap member 8 against the nozzle surface of the ejection head 22, a suction pump (not illustrated) that introduces a negative pressure into the closed space formed by the cap member 8 being pressed against the nozzle surface of the ejection head 22, or the like.

In the present embodiment, in a use state of the printing system 1, an axis along the sub-scanning direction in which the printing sheet 2 is transported is the Y axis, an axis along a gravity direction is the Z axis, and an axis along a moving direction of the carriage 20 is the X axis. Here, the "use state of the printing system 1" refers to a state in which the printing system 1 is installed on a horizontal surface. In addition, in the present embodiment, the sub-scanning direction is the +Y direction, an opposite direction to the +Y direction is the −Y direction, the gravity direction is the −Z direction, and an antigravity direction is the +Z direction. The X direction and the Y direction are directions along a horizontal direction. In addition, when the printing system 1 is viewed from a front side, a direction from a right side to a left side is the +X direction, and an opposite direction to the +X direction is the −X direction. In addition, in the present embodiment, an insertion direction D1 in which the cartridge 4 is inserted into the cartridge mounting portion 6 for mounting is the −Y direction, and a direction in which the cartridge 4 is removed from the cartridge mounting portion 6 is the +Y direction. Therefore, a −Y direction side of the cartridge mounting portion 6 is also referred to as a rear side, and a +Y direction side of the cartridge mounting portion 6 is also referred to as a front side. In addition, in the present embodiment, an arrangement direction of the plurality of cartridges 4 is the X direction.

A-2. Schematic Configuration of Mounted State of Cartridge 4

Figure 2:
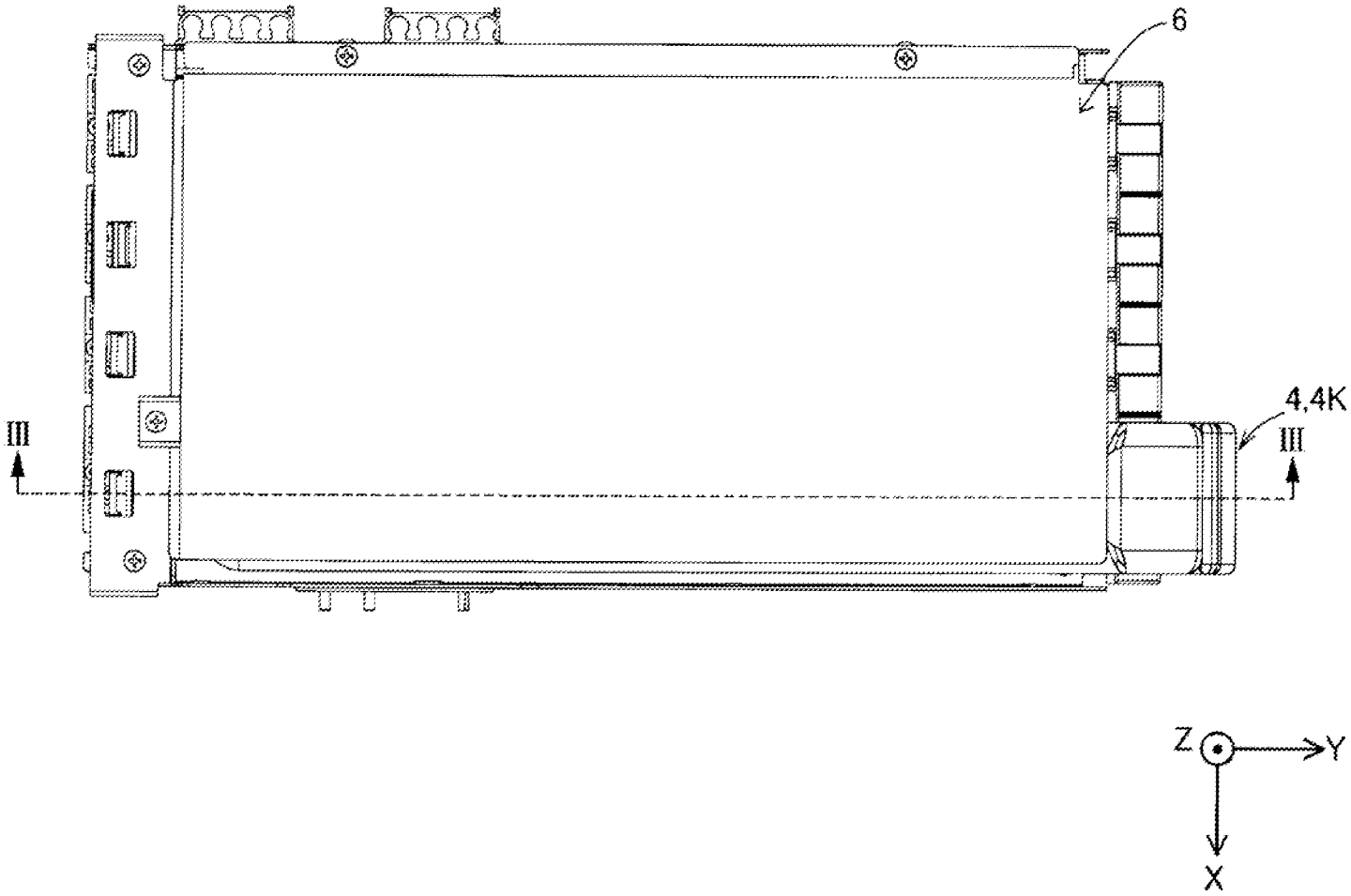
FIG. 2 is a view of a cartridge mounting portion when viewed from a +Z direction side.
Figure 3:
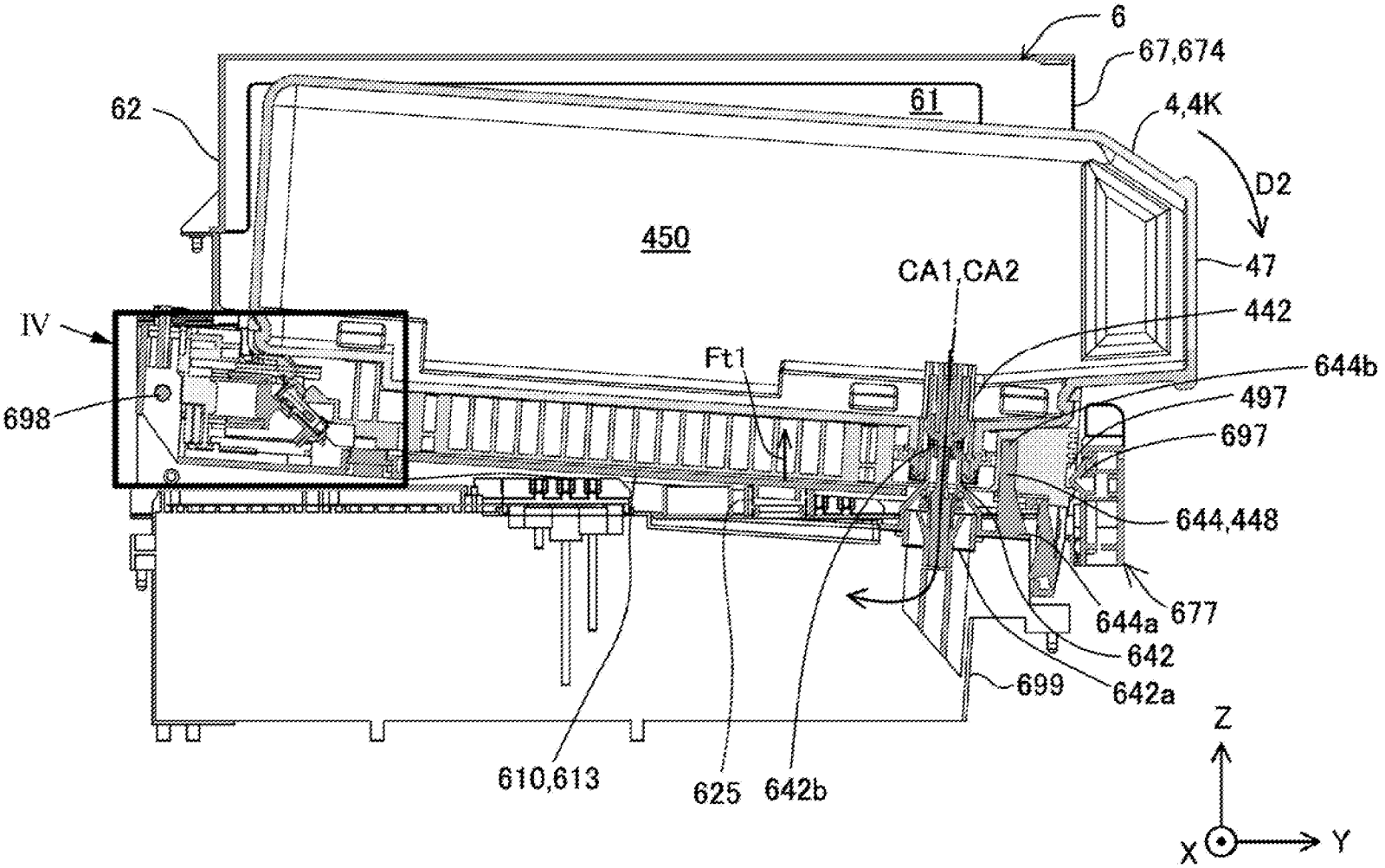
FIG. 3 is a sectional view taken along line III-III of FIG. 2.
Figure 4:
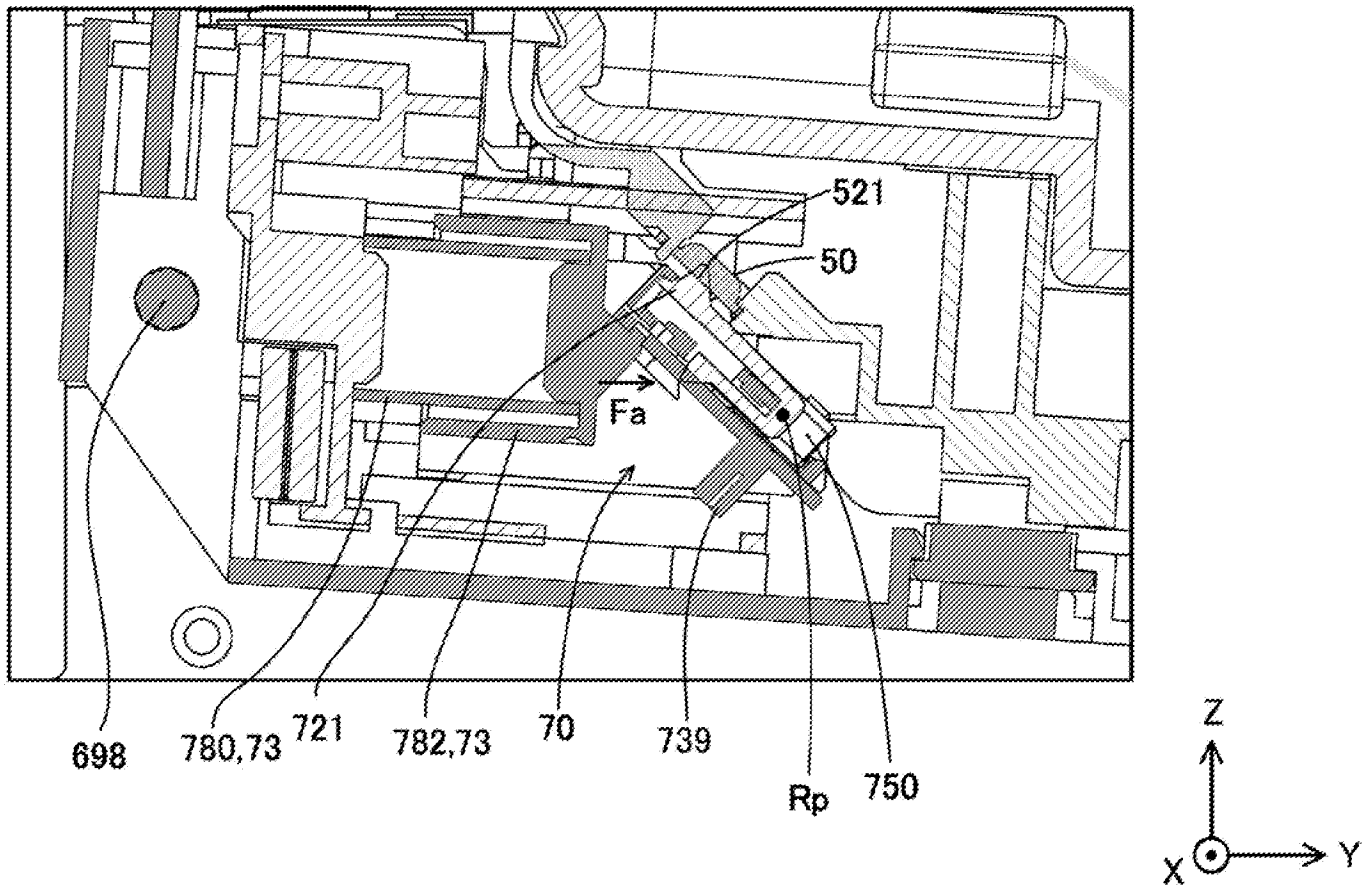
FIG. 4 is an enlarged view of region IV of FIG. 3.

FIG. 2 is a view of the cartridge mounting portion 6 when viewed from the +Z direction side. FIG. 3 is a sectional view taken along line III-III of FIG. 2. FIG. 4 is an enlarged view of a region IV of FIG. 3. In FIG. 2, the cartridge 4K is mounted in the cartridge mounting portion 6. A mounting process and a schematic configuration of a mounted state of the cartridge 4 will be described with reference to FIGS. 2 to 4. Note that the mounting process and mounted state are the same for the cartridges 4C, 4M, 4Y, and 4K.

As illustrated in FIG. 3, the cartridge 4 is inserted along the insertion direction D1 and is inserted into an accommodation chamber 61 of the cartridge mounting portion 6 through an insertion/removal opening 674 of a first device wall 67 of the cartridge mounting portion 6. As a result, the accommodation chamber 61 accommodates the cartridge 4. The insertion/removal opening 674 is an entrance/exit of the accommodation chamber 61 of the cartridge 4. In a state in which the cartridge 4 is inserted into the accommodation chamber 61 of the cartridge mounting portion 6, the cartridge 4 is supported from a −Z direction side by a support member 610 of the cartridge mounting portion 6. In addition, in the mounted state that the cartridge 4 is mounted in the accommodation chamber 61 of the cartridge mounting portion 6, a liquid supply portion 442 of the cartridge 4 and a liquid introduction portion 642 of the cartridge mounting portion 6 are coupled to each other. As a result, the ink contained in a liquid containing portion 450 of the cartridge 4 is supplied to the liquid introduction portion 642 via the liquid supply portion 442. In addition, in the present embodiment, the ink is supplied from the liquid supply portion 442 to the liquid introduction portion 642, while air contained in the liquid storage portion 699 flows, as air bubbles, through the liquid introduction portion 642 and the liquid supply portion 442 to the liquid containing portion 450. As a result, gas-liquid exchange in the liquid containing portion 450 is performed. Note that in another embodiment, the cartridge 4 may have an atmospheric communication path communicating the liquid containing portion 450 with the outside, and gas-liquid exchange may be performed through the atmospheric communication path. The atmospheric communication path is arranged at a location different from that of the liquid supply portion 442 and is formed, for example, on a wall forming the liquid containing portion 450.

The liquid introduction portion 642 receives the liquid supplied from the cartridge 4. The liquid introduction portion 642 is a tubular member and has an internal flow path for making the liquid flow therein. The liquid introduction portion 642 has a base end portion 642*a* and a tip portion 642*b*. The tip portion 642*b* is formed with an opening communicating with the internal flow path, and the ink of the liquid supply portion 442 flows to the internal flow path through the opening. The base end portion 642*a* is coupled to the liquid storage portion 699 and makes the ink that has flowed through the internal flow path flow to the liquid storage portion 699. The liquid storage portion 699 is located on a −Z direction side of the accommodation chamber 61. The liquid storage portion 699 communicates with the ejection head 22 via the tube 24 illustrated in FIG. 1. As described above, the liquid introduction portion 642 communicates with the ejection head 22 via the liquid storage portion 699 and the tube 24. A central axis CA1 of the liquid introduction portion 642 is parallel to a central axis CA2 of the liquid supply portion 442 in the mounted state and is inclined with respect to the Z direction. That is, a direction along the central axis CA1, which is a direction in which the liquid introduction portion 642 extends, intersects the insertion direction D1. A direction along the central axis CA2 of the liquid supply portion 442 is a direction in which the liquid supply portion 442 extends.

As illustrated in FIG. 4, in the mounted state of the cartridge 4, a circuit board 50 of the cartridge 4 and a device side terminal portion 70 of the cartridge mounting portion 6 are electrically coupled to each other by coming into contact with each other. The device side terminal portion 70 is held by a holding mechanism 73. The device side terminal portion 70 includes a plurality of device side terminals 721, a terminal holding portion 750, and a connector 739.

The plurality of device side terminals 721 (nine device side terminals in the present embodiment) are provided. Each of the plurality of device side terminals 721 is a conductive metal plate member. The device side terminal 721 has a terminal rotation fulcrum Rp, and a portion in contact with a cartridge side terminal 521 of the circuit board 50, which is an end portion, can be elastically deformed using the terminal rotation fulcrum Rp as a fulcrum. A direction in which the portion is elastically deformed is a direction along the Y direction and the Z direction. The terminal holding portion 750 holds the plurality of device side terminals 721. The connector 739 is electrically coupled to the plurality of device side terminals 721. In addition, the connector 739 is electrically coupled to the control portion 31 of the printing device 10 by wiring (not illustrated). As a result, the circuit board 50 and the control portion 31 can perform data communication therebetween.

The holding mechanism 73 includes an urging member 780 and an attaching member 782. The urging member 780 is formed of a coil spring. The urging member 780 is arranged at inner side of the attaching member 782. In addition, the device side terminal portion 70 is attached to the attaching member 782. The urging member 780 is compressed in a state in which the insertion of the cartridge 4 into the cartridge mounting portion 6 is completed. As a result, the urging member 780 applies, to the device side terminal portion 70 via the attaching member 782, an external force Fa in a direction toward a removal direction side of the cartridge 4, which is the first device wall 67 side. Since the device side terminal portion 70 is pressed against the circuit board 50 by the external force Fa, contact between the device side terminal 721 and the cartridge side terminal 521 is maintained well.

As described above, the holding mechanism 73 holds the device side terminal portion 70 so that the device side terminal portion 70 is displaceable in a direction along the insertion direction D1 of the cartridge 4. In addition, one end portion of the urging member 780 adjacent to the device side terminal portion 70 is configured to be slightly movable in the X direction and the Z direction intersecting the insertion direction D1. As a result, the device side terminal portion 70 is held by the holding mechanism 73 so as to be slightly movable in the X direction and the Z direction intersecting the insertion direction D1.

A mounting process of the cartridge 4 to the cartridge mounting portion 6 includes a terminal coupling process and a supply portion coupling process executed after the terminal coupling process. The terminal coupling process is a process of bringing and electrically coupling the device side terminal 721 and the cartridge side terminal 521 into contact with and to each other by moving the cartridge 4 in the −Y direction to insert the cartridge 4 into the accommodation chamber 61 of the cartridge mounting portion 6 through the insertion/removal opening 674 of the first device wall 67. The supply portion coupling process is a process of coupling the liquid introduction portion 642 and the liquid supply portion 442 to each other by rotationally moving, in a state of maintaining the electrical coupling between the device side terminal 721 and the cartridge side terminal 521 as illustrated in FIG. 3, a rear surface 47 side of the cartridge 4 in a coupling direction D2 indicated by an arrow with a rotation fulcrum 698, serving as a displacement mechanism included in the support member 610, as a fulcrum. The rotation fulcrum 698 is provided adjacent to a second device wall 62 of the cartridge mounting portion 6.

In the supply portion coupling process, a device side supply portion positioning portion 644, which is a projection included in the cartridge mounting portion 6, enters a supply portion positioning portion 448 included in the cartridge 4 and having a recessed shape, so that the movement of the liquid supply portion 442 in a direction intersecting the central axis CA2 of the liquid supply portion 442 is regulated. As a result, positioning of the liquid supply portion 442 with respect to the liquid introduction portion 642 is performed. The device side supply portion positioning portion 644 has a substantially rectangular parallelepiped shape. The device side supply portion positioning portion 644 has one end portion 644*a* as a base end portion and the other end portion 644*b* as a tip portion. The one end portion 644*a* is located adjacent to the liquid storage portion 699. The one end portion 644*a* is located more adjacent to the accommodation chamber 61 than the other end portion 644*b* is.

In the mounted state of the cartridge 4, a main wall 613 forming a bottom portion of the support member 610 is inclined with respect to the Y direction. Specifically, the main wall 613 of the support member 610 is inclined so as to be located closer to the −Z direction side, which is a lower side, as the main wall 613 extends toward a +Y-axis direction. The main wall 613 is parallel to the Y direction in an initial arrangement state of the cartridge mounting portion 6 to which the cartridge 4 is not mounted.

The cartridge mounting portion 6 includes a device urging member 625 that applies an external force Ft1 to the support member 610 in order to return the support member 610 to a location of the initial arrangement state in the mounted state of the cartridge 4. The device urging member 625 is a coil spring provided between the support member 610 and the liquid storage portion 699 and is in a compressed state in the mounted state. The device urging member 625 applies in the compressed state the external force Ft1 having a +Z direction component to the support member 610. On the other hand, in the mounted state of the cartridge 4, a cartridge engaging portion 497 of the cartridge 4 engages with a mounting engaging portion 697 of the cartridge mounting portion 6, so that the mounted state is maintained. The mounting engaging portion 697 is formed on an engagement forming body 677 of the cartridge mounting portion 6.

A-3. Detailed Configuration of Cartridge Mounting Portion 6

Figure 5:
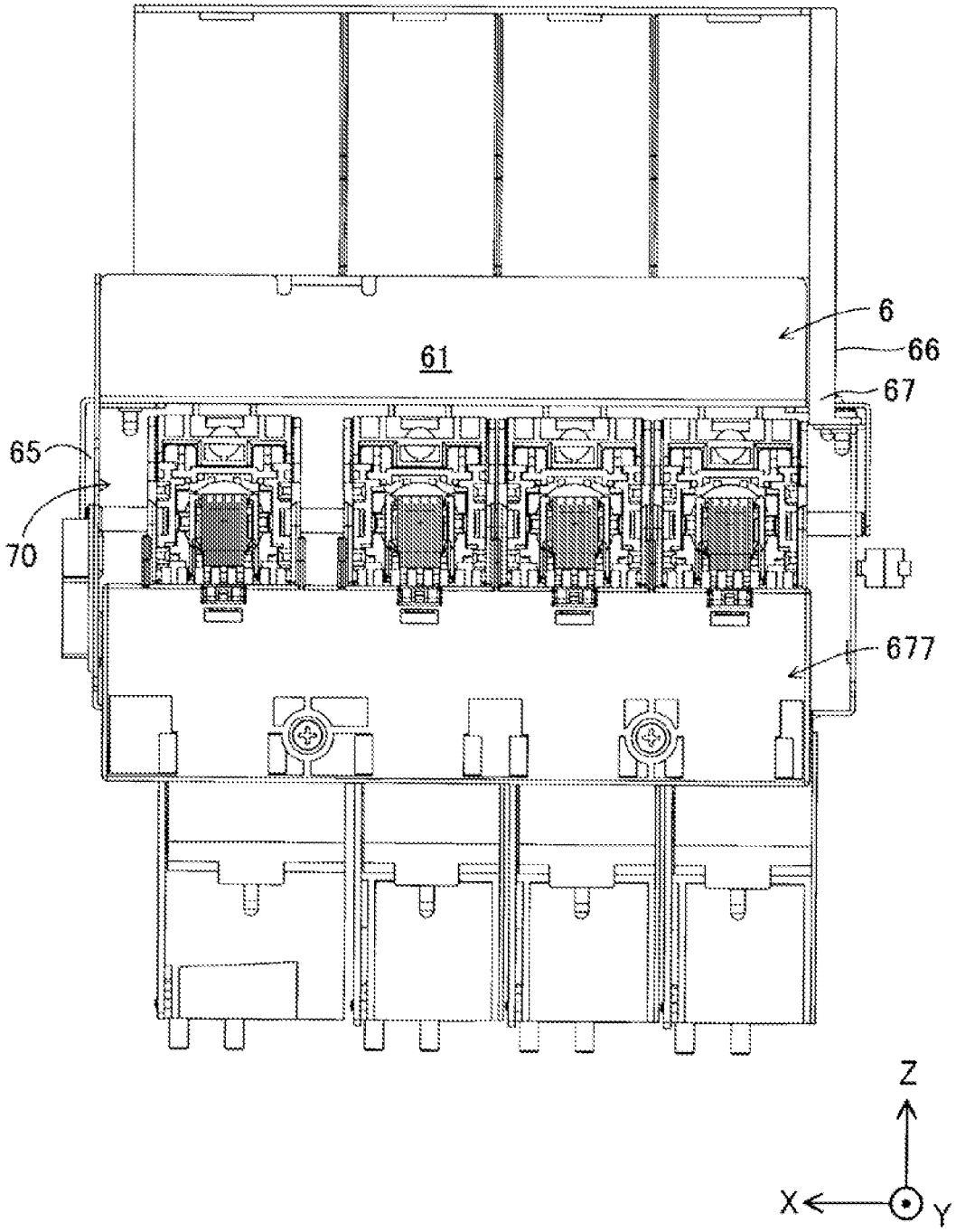
FIG. 5 is a view of the cartridge mounting portion when viewed from a +Y direction side.
Figure 6:
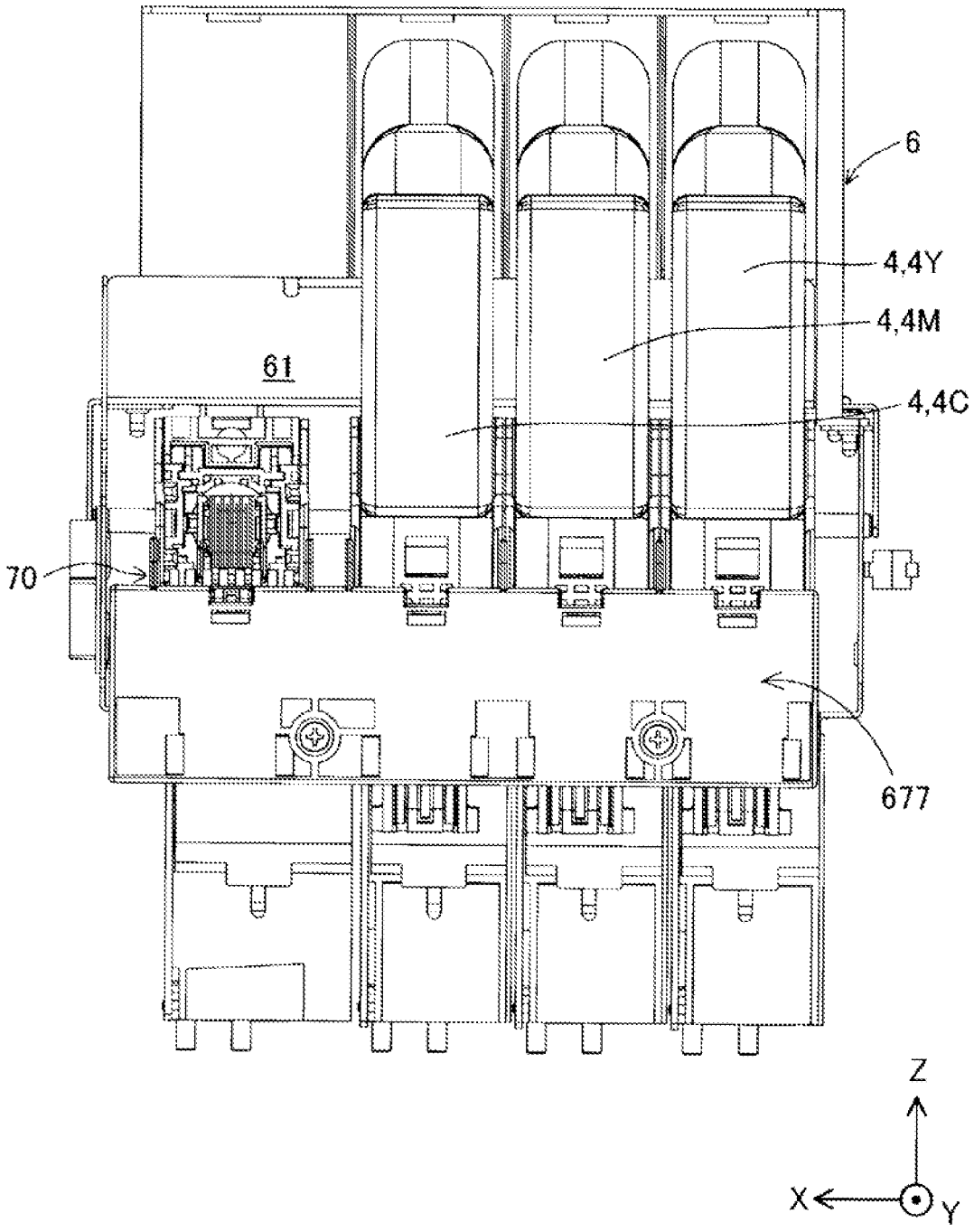
FIG. 6 is a view illustrating that a cartridge is mounted in the cartridge mounting portion.
Figure 7:
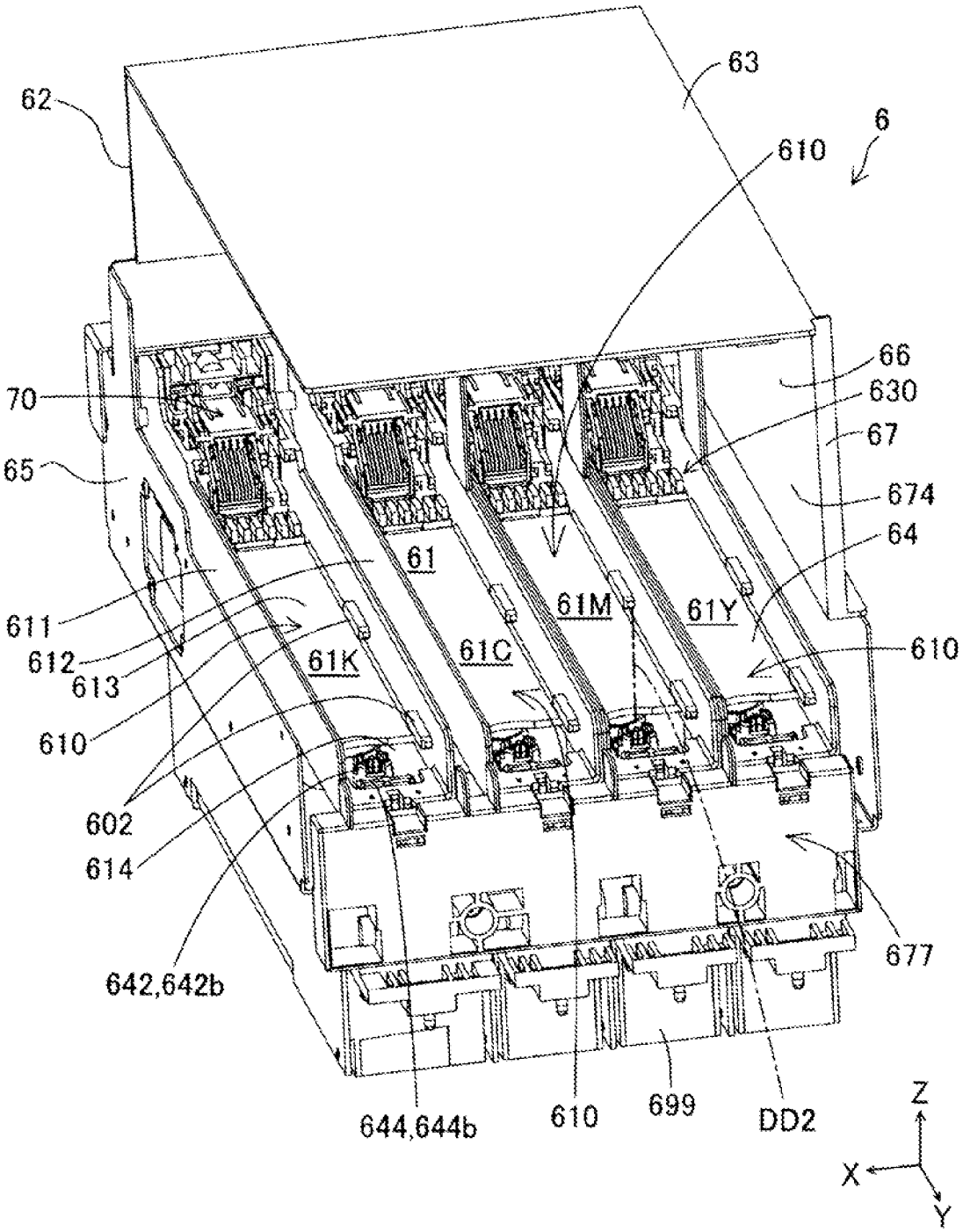
FIG. 7 is a perspective view of the cartridge mounting portion.
Figure 8:
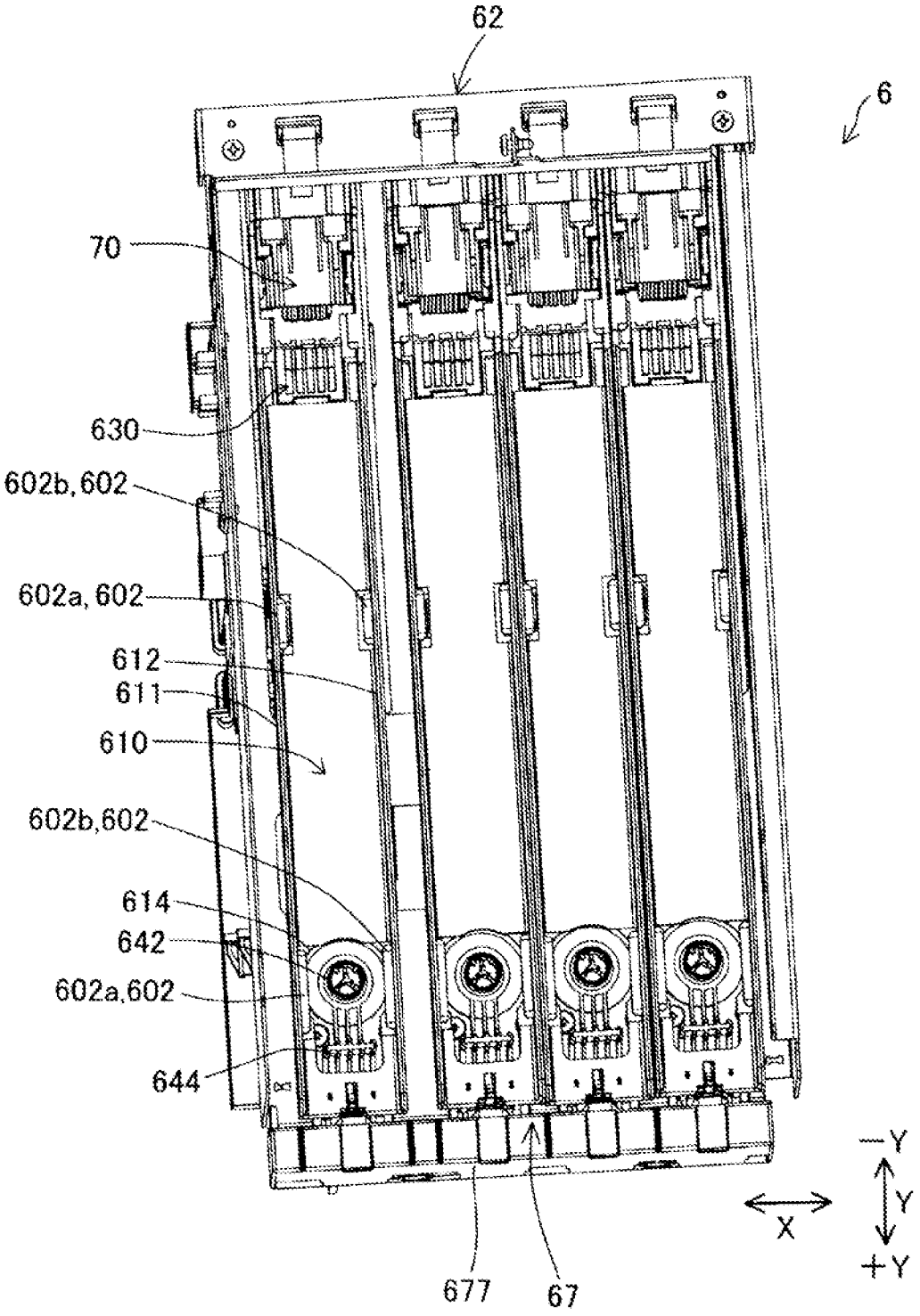
FIG. 8 is a view of the cartridge mounting portion when viewed from the +Z direction side.
Figure 9:
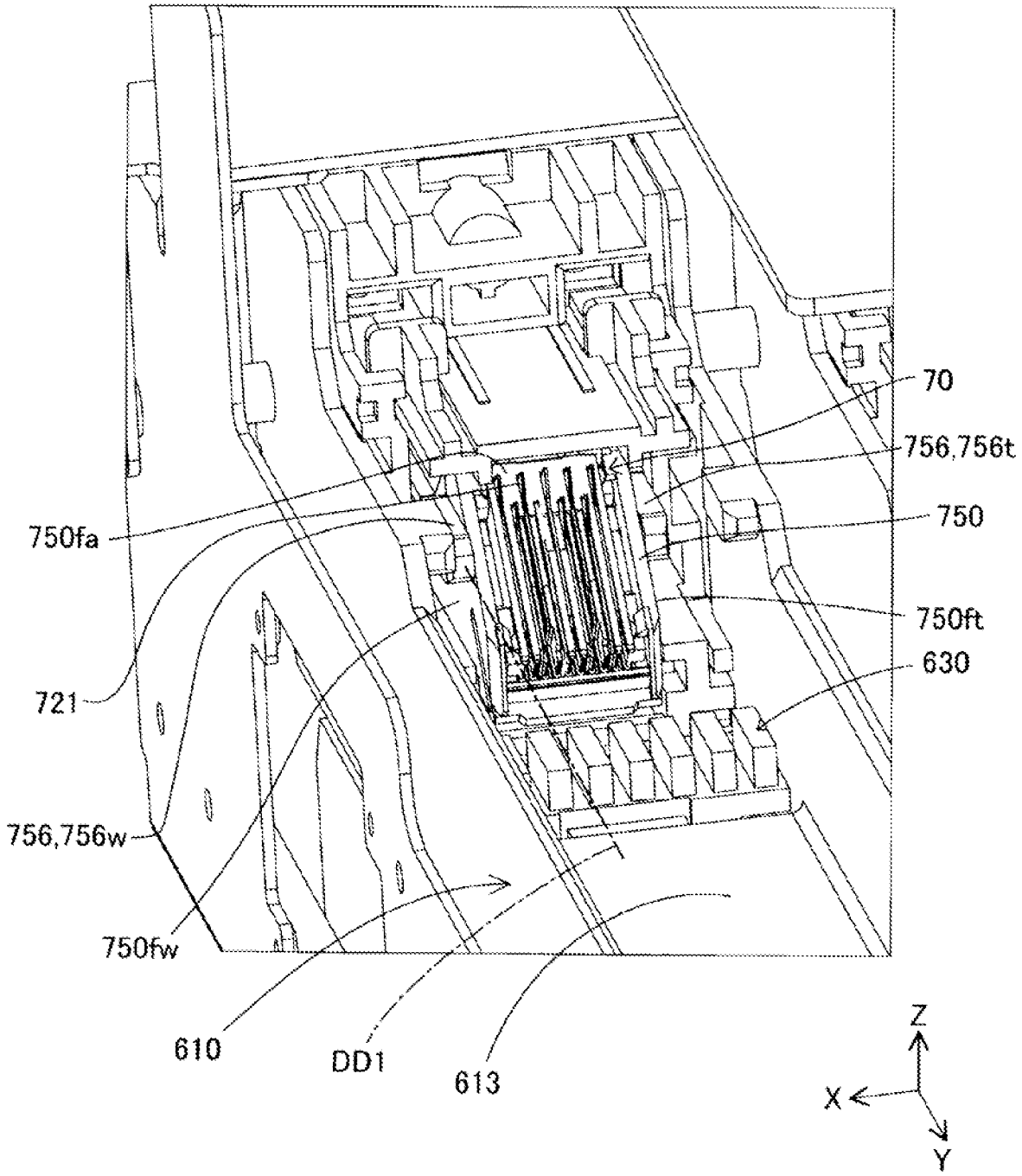
FIG. 9 is a partially enlarged view of the cartridge mounting portion.
Figure 10:
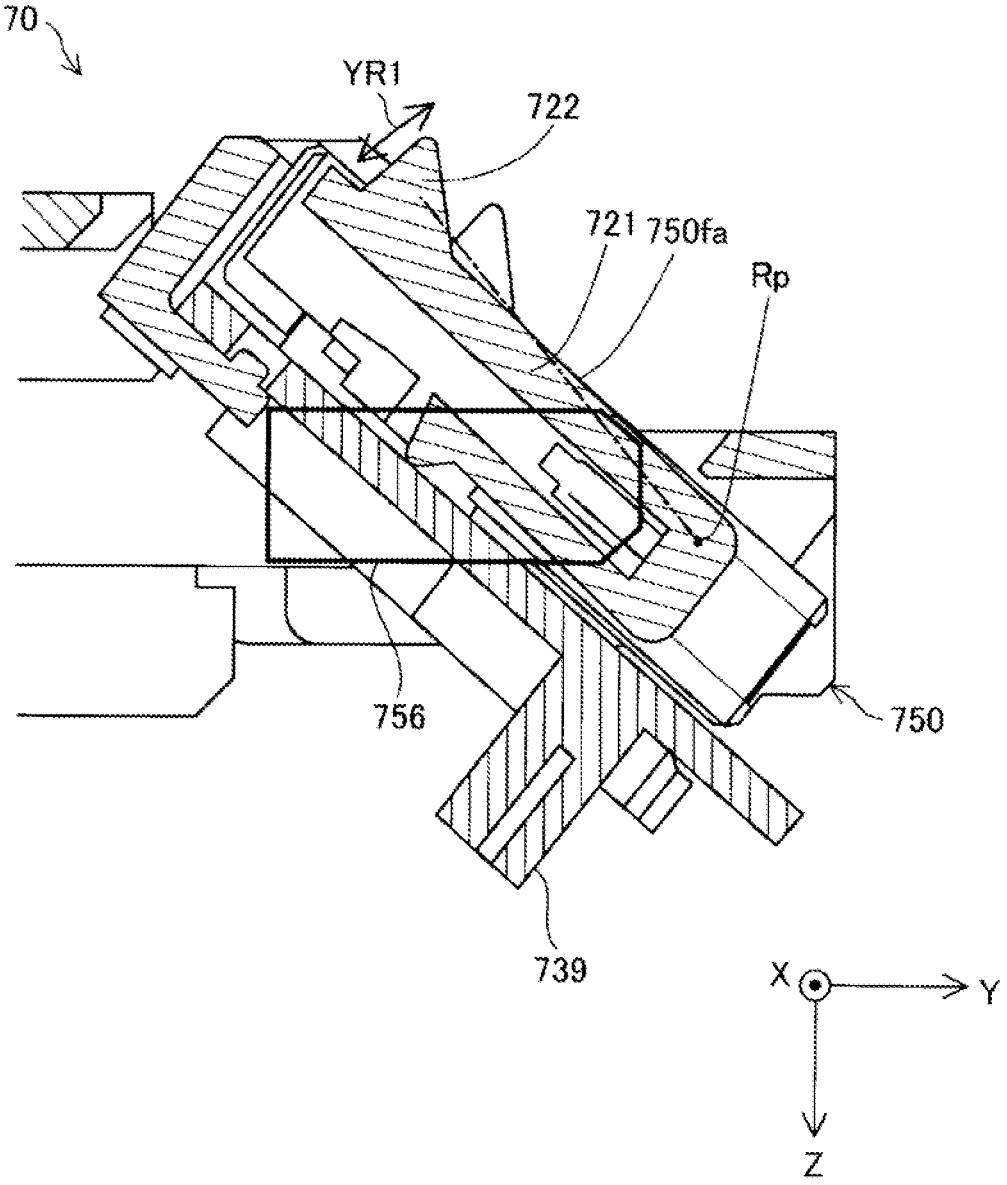
FIG. 10 is a schematic sectional view of a device side terminal portion.

FIG. 5 is a view of the cartridge mounting portion 6 when viewed from the +Y direction side. FIG. 6 is a view illustrating that the cartridge 4 is mounted in the cartridge mounting portion 6. FIG. 7 is a perspective view of the cartridge mounting portion 6. FIG. 8 is a view of the cartridge mounting portion 6 when viewed from the +Z direction side. FIG. 9 is a partially enlarged view of the cartridge mounting portion 6. FIG. 10 is a schematic sectional view of the device side terminal portion 70. In FIGS. 6 to 10, some of the components of the cartridge mounting portion 6 are not illustrated in order to facilitate understanding. Regarding the cartridge mounting portion 6, the X direction is also referred to as a width direction, the Y direction is also referred to as a depth direction, and the Z direction is also referred to as a height direction. In the following, unless there is a particular description about a state, each element will be described on the premise of the cartridge mounting portion 6 in the initial arrangement state that the cartridge 4 is not mounted in the cartridge mounting portion 6.

As illustrated in FIGS. 5 to 7, in the cartridge mounting portion 6, the accommodation chamber 61 in which the cartridge 4 is accommodated is formed. The accommodation chamber 61 has a substantially rectangular parallelepiped shape. Slots 61C, 61M, 61Y, and 61K, which are portions of the accommodation chamber 61 for accommodating respective cartridges 4C, 4M, 4Y, and 4K, generally correspond to appearance shapes of the respective cartridges 4C, 4M, 4Y, and 4K. In the present embodiment, the cartridge 4K has a greater dimension in the X direction than the other cartridges 4C, 4M, and 4Y in order to increase an amount of liquid to be contained. Therefore, in the present embodiment, a width of the slot 61K is greater than that of the other slots 61C, 61M, and 61Y.

As illustrated in FIG. 7, the cartridge mounting portion 6 has six device walls 62, 63, 64, 65, 66, and 67 forming the accommodation chamber 61. In the present disclosure, the term "wall" is a concept including a wall composed of a plurality of walls in addition to a single wall. The second device wall 62 forms a wall of the accommodation chamber 61 on the −Y direction side. The second device wall 62 is a substantially vertical wall in a use state of the printing device 10.

The first device wall 67 faces the second device wall 62 in the Y direction. Inside the first device wall 67, the insertion/removal opening 674 through which the cartridge 4 passes when the cartridge 4 is inserted into or removed from the accommodation chamber 61 is formed.

A device top wall 63 forms a wall of the accommodation chamber 61 on the +Z direction side. A device bottom wall 64 faces the device top wall 63 in the Z direction and forms a wall of the accommodation chamber 61 on the −Z direction side. The device bottom wall 64 is formed by the support member 610. The device bottom wall 64 has a plurality of openings 614. In the present embodiment, four openings 614 are formed according to the slots 61C, 61M, 61Y, and 61K. The device top wall 63 and the device bottom wall 64 intersect the second device wall 62 and the first device wall 67. In the present disclosure, the term "cross" or "intersect" means any one of (i) a state in which two elements intersect or actually cross each other, (ii) a state in which one element crosses the other element when one element has extended, and (iii) a state in which mutual elements intersect each other when the mutual elements have extended.

A first device side wall 65 forms a wall of the accommodation chamber 61 on the +X direction side. A second device side wall 66 faces the first device side wall 65 in the X direction and forms a wall of the accommodation chamber 61 on the −X direction side. The first device side wall 65 and the second device side wall 66 intersect the second device wall 62, the first device wall 67, the device top wall 63, and the device bottom wall 64.

As illustrated in FIGS. 7 and 8, the cartridge mounting portion 6 further includes the support member 610, the liquid introduction portion 642, the supply portion positioning portion 644, device guide portions 602, and the engagement forming body 677. A plurality of support members 610 are provided according to the number of cartridges 4 to be mounted. In the present embodiment, four support members 610 are provided. The support member 610 forms the device bottom wall 64 of the accommodation chamber 61 on a gravity direction side. The support member 610 supports the cartridge 4 from the −Z direction side, which is the gravity direction side. The support member 610 is a member extending along the Y direction. The support member 610 has a recessed shape. The support member 610 has a main wall 613 forming the device bottom wall 64, a first support side wall 611, and a second support side wall 612.

The main wall 613 forms a bottom portion located on the gravity direction side and having a recessed shape. The openings 614 are formed at an end portion of the main wall 613 adjacent to the first device wall 67. The openings 614 penetrate through the main wall 613 in a thickness direction of the main wall 613.

As illustrated in FIG. 7, the first support side wall 611 rises from a +X direction side end portion of the main wall 613 in the +Z direction, which is the antigravity direction. The second support side wall 612 rises from a −X direction side end portion of the main wall 613 in the +Z direction. The first support side wall 611 and the second support side wall 612 face each other in the X direction.

The device guide portions 602 guide the cartridge 4 in the insertion direction D1 and a removal direction. The device guide portion 602 is provided for each support member 610. The device guide portions 602 are provided on each of the first support side wall 611 and the second support side wall 612. The device guide portions 602 are projections provided on the first support side wall 611 and the second support side wall 612. As illustrated in FIG. 8, a first device guide portion 602*a* provided on the first support side wall 611 is a projection protruding from the first support side wall 611 toward the second support side wall 612. The first device guide portion 602*a* extends along the Y direction. In addition, a plurality of first device guide portions 602*a* are arranged at intervals in the Y direction. A second device guide portion 602*b* provided on the second support side wall 612 is a projection protruding from the second support side wall 612 toward the first support side wall 611. The second device guide portion 602*b* extends along the Y direction. In addition, a plurality of second device guide portions 602*b* are arranged at intervals in the Y direction.

As illustrated in FIGS. 7 and 8, the liquid introduction portion 642 receives the liquid of the cartridge 4. In the initial arrangement state of the cartridge mounting portion 6, the liquid introduction portion 642 is not located in the accommodation chamber 61, but is located on the −Z direction side with respect to the accommodation chamber 61. That is, the liquid introduction portion 642 is located on an opposite side of the support member 610 from the accommodation chamber 61. As a result, when the cartridge 4 is inserted into the accommodation chamber 61 of the cartridge mounting portion 6, it is possible to prevent the cartridge 4 from colliding with the liquid introduction portion 642. As described above, as illustrated in FIG. 3, the tip portion 642*b* of the liquid introduction portion 642 is arranged in the accommodation chamber 61 by rotationally moving the support member 610 around the rotation fulcrum 698 in the coupling direction D2 to push down the openings 614. That is, the rotation fulcrum 698 as the displacement mechanism arranges the tip portion 642*b* of the liquid introduction portion 642 and the other end portion 644*b* of the device side supply portion positioning portion 644 in the accommodation chamber 61 through the openings 614 by rotationally moving the support member 610 to displace the openings 614 toward the gravity direction.

The device side supply portion positioning portion 644 illustrated in FIG. 7 is received by the supply portion positioning portion 448 to regulate the movement of the liquid supply portion 442 with respect to the liquid introduction portion 642. As a result, positioning of the liquid supply portion 442 is performed. In the initial arrangement state of the cartridge mounting portion 6, the device side supply portion positioning portion 644 is not located in the accommodation chamber 61, but is located on the −Z direction side with respect to the accommodation chamber 61. That is, the device side supply portion positioning portion 644 is located on an opposite side of the support member 610 from the accommodation chamber 61. As a result, when the cartridge 4 is inserted into the accommodation chamber 61 of the cartridge mounting portion 6, it is possible to prevent the cartridge 4 from colliding with the device side supply portion positioning portion 644. The other end portion 644*b* of the device side supply portion positioning portion 644 is arranged in the accommodation chamber 61 by rotating the support member 610 around the rotation fulcrum 698 in the coupling direction D2 to push down the openings 614. That is, the rotation fulcrum 698 arranges the other end portion 644*b* of the device side supply portion positioning portion 644 in the accommodation chamber 61 through the openings 614 by rotating the support member 610 to displace the openings 614. The device side supply portion positioning portion 644 is a columnar member that rises from a top wall of the liquid storage portion 699. A device second direction DD2, which is a direction in which the device side supply portion positioning portion 644 extends, has a Z direction component and a Y direction component. In the present embodiment, the device second direction DD2 is inclined so that the device second direction DD2 and the Z direction form an angle in the range of greater than 0° and 15° or less.

As illustrated in FIG. 8, the cartridge mounting portion 6 further includes the device side terminal portion 70 and a device side identification member 630. As illustrated in FIG. 9, the terminal holding portion 750 included in the device side terminal portion 70 includes a holding portion surface 750*fa* on which the device side terminal 721 is exposed, a first holding portion side wall 750*ft*, and a second holding portion side wall 750*fw*. The first holding portion side wall 750*ft* forms a side wall of the terminal holding portion 750 on the −X direction side. The second holding portion side wall 750*fw* forms a side wall of the terminal holding portion 750 on the +X direction side.

As illustrated in FIGS. 8 and 9, the device side identification members 630 are used to identify whether or not correct types of cartridges 4C, 4M, 4Y, and 4K have been inserted into the respective slots 61C, 61M, 61Y, and 61K of the accommodation chamber 61. The device side identification members 630 form different pattern shapes depending on colors of the liquids contained in the cartridges 4C, 4M, 4Y, and 4K. In FIG. 8, in the respective slots 61C, 61M, 61Y, and 61K, the device side identification members 630 have the same pattern shape for convenience, but actually have different pattern shapes. The device side identification member 630 is provided on the main wall 613 of the support member 610.

As illustrated in FIG. 9, the device side identification member 630 is formed by at least one or more ribs. The pattern shape is determined by the number and locations of ribs. The cartridges 4 are also provided with cartridge side identification members formed by ribs. The cartridge side identification members form different pattern shapes depending on a type of the cartridge 4, that is, the colors of the liquids to be contained in the cartridges. When correct types of cartridges 4 are inserted into the corresponding slots 61C to 61K, the device side identification members 630 and the cartridge side identification members are fitted into each other without colliding with each other. On the other hand, when wrong types of cartridges 4 are inserted into the slots 61C to 61K, the device side identification members 630 and the cartridge side identification members collide with each other, so that further insertion of the cartridges 4 is hindered. As a result, a possibility that the wrong types of cartridges 4 will be mounted in the respective slots 61C to 61K of the cartridge mounting portion 6 can be reduced.

As illustrated in FIG. 9, the device side terminal portion 70 includes a device side terminal positioning portion 756 in addition to the plurality of device side terminals 721, the terminal holding portion 750, and the connector 739 described above. The device side terminal positioning portion 756 is received by a terminal positioning portion of the cartridge 4 in an insertion process of the cartridge 4 into the accommodation chamber 61, so that movement of the device side terminal positioning portion 756 in the X and Z directions, which are directions intersecting the insertion direction D1, is regulated. As a result, positioning of the device side terminal 721 and the cartridge side terminal 521 in the directions intersecting the insertion direction D1 is performed.

Two device side terminal positioning portions 756 are provided for each of the slots 61C to 61K. One of the two device side terminal positioning portions 756 is also referred to as a first device side terminal positioning portion 756*t*, and the other of the two device side terminal positioning portions 756 is also referred to as a second device side terminal positioning portion 756*w*. The first device side terminal positioning portion 756*t* and the second device side terminal positioning portion 756*w* are columnar members extending in a device first direction DD1, respectively. In the present embodiment, the device first direction DD1 is the Y direction, and is the direction along the insertion direction D1 of the cartridge. The device first direction DD1 is a direction intersecting the device second direction DD2. The first device side terminal positioning portion 756*t* is provided on the first holding portion side wall 750*ft*. The second device side terminal positioning portion 756*w* is provided on the second holding portion side wall 750*fw*.

As illustrated in FIG. 10, the holding portion surface 750*fa* of the terminal holding portion 750 is inclined with respect to the Y direction and the Z direction toward a direction including a +Y direction component and a +Z direction component. A terminal contact 722 of the device side terminal 721 in contact with the circuit board 50 protrudes from the holding portion surface 750*fa*. The terminal contact 722 is in a state of being elastically deformable in a direction of an arrow YR1. A+Y direction side end portion of the device side terminal positioning portion 756 is located on the +Y direction side with respect to the terminal contact 722.

As illustrated in FIG. 9, the device side terminal portion 70 and the device side identification member 630 are provided on the support member 610, respectively. In the Y direction, which is the direction in which the support member 610 extends, the device side terminal portion 70 and the device side identification member 630 are located on an opposite side of the first device wall 67 from the liquid introduction portion 642 or the opening 614. Specifically, the device side terminal portion 70 and the device side identification member 630 are provided in the vicinity of the second device wall 62. In addition, the device side terminal portion 70 is located on the second device wall 62 side, which is on the −Y direction side with respect to the device side identification member 630. As a result, in the insertion process of the cartridge 4, after the fitting between the cartridge side identification member and the device side identification member 630 is started, contact between the device side terminal 721 and the cartridge side terminal 521 is started. Therefore, it is possible to prevent a storage device of the circuit board 50 and the control portion 31 from being electrically coupled to each other in a state in which the cartridge side terminal 521 of the wrong type of cartridge 4 and the device side terminal 721 come into contact with each other, so that the wrong type of cartridge 4 is mounted.

As illustrated in FIG. 7, the engagement forming body 677 is formed on the +Y direction side with respect to the support member 610. In addition, the engagement forming body 677 is located on the −Z direction side with respect to the insertion/removal opening 674. Four mounting engaging portions 697 illustrated in FIG. 3 are arranged in the engagement forming body 677 so as to corresponding to the respective slots 61C to 61K.

A-4. Detailed Configuration of Cartridge 4

Figure 11:
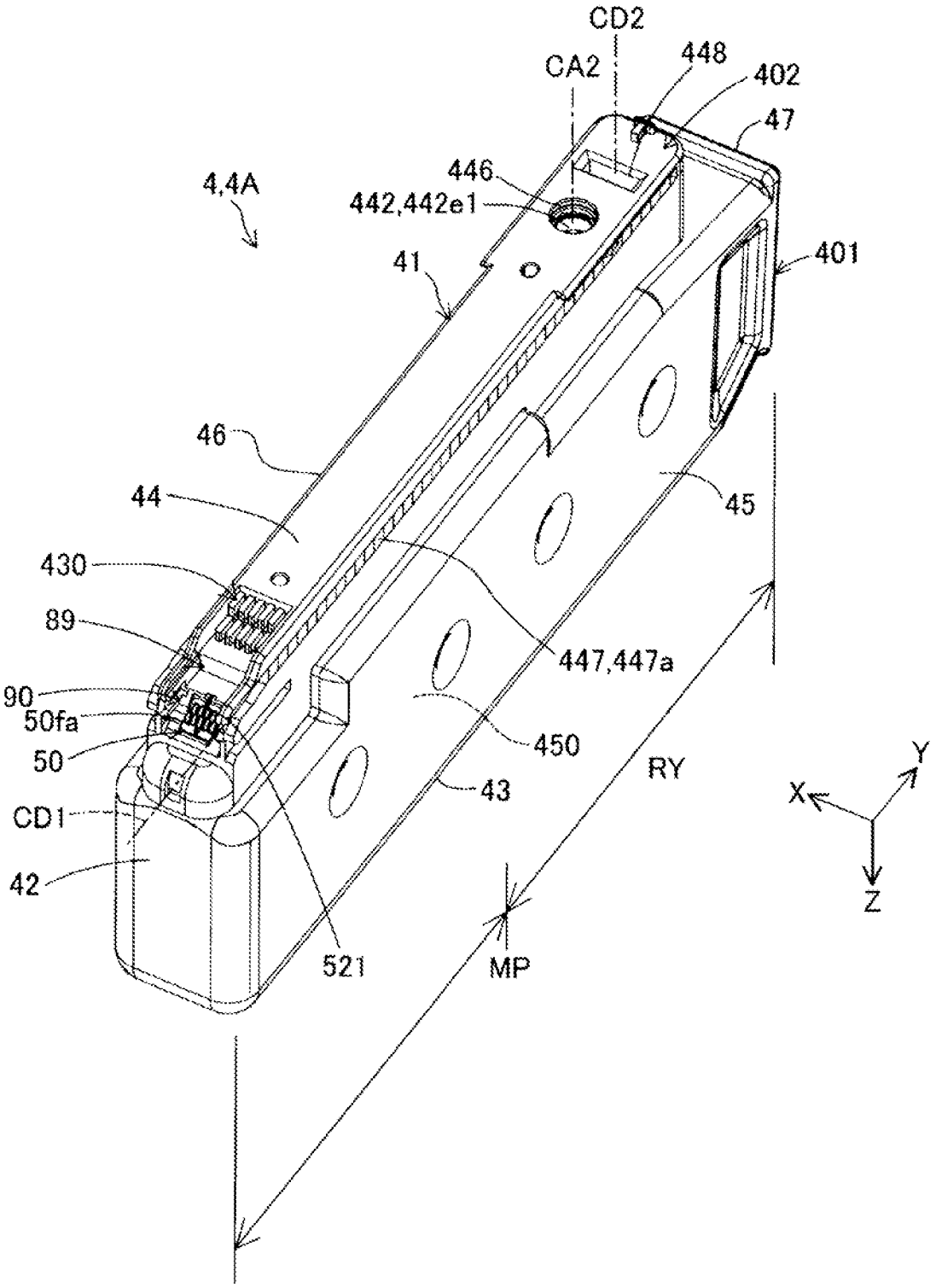
FIG. 11 is a perspective view of a first type of cartridge.
Figure 12:
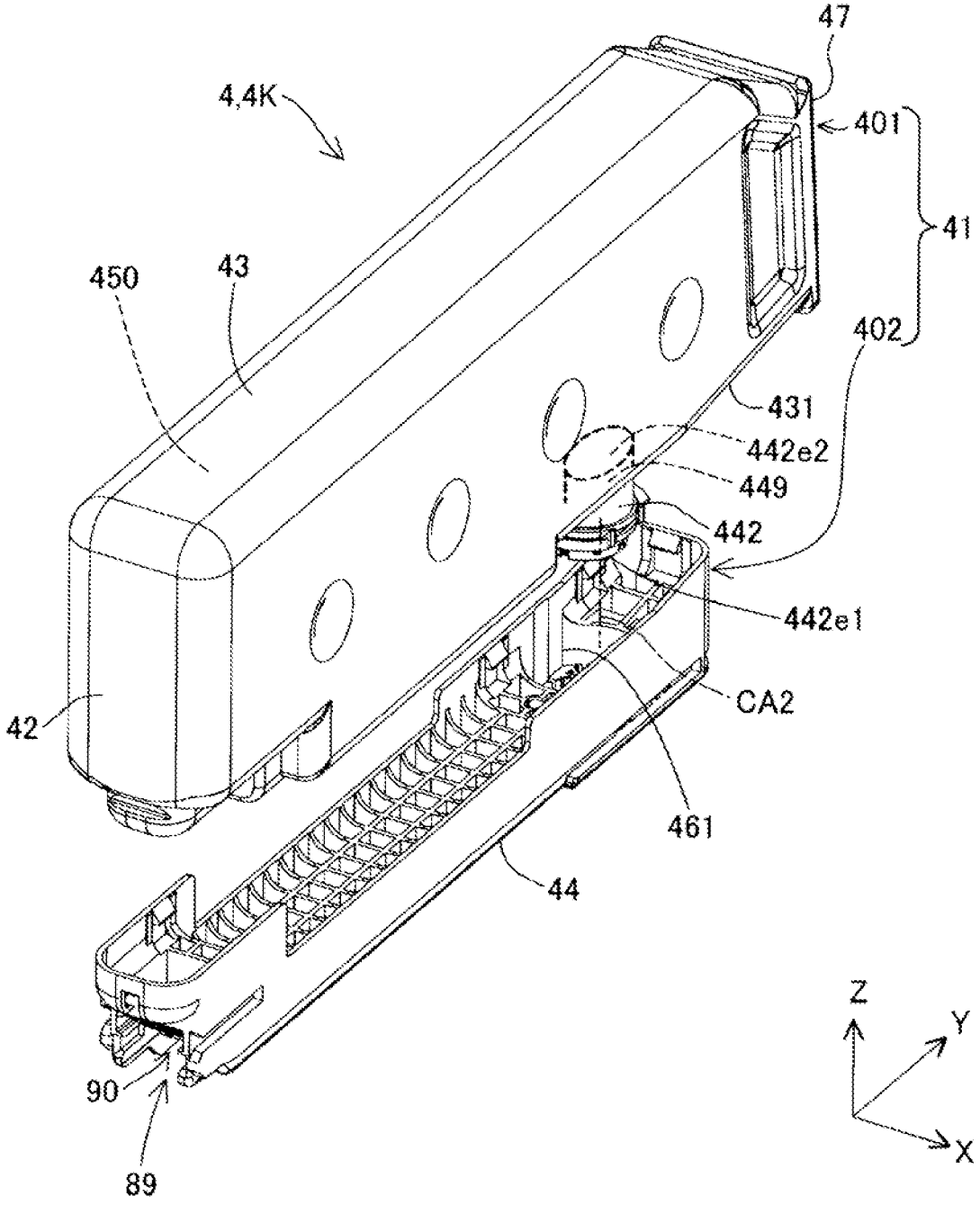
FIG. 12 is an exploded perspective view of the first type of cartridge.
Figure 13:
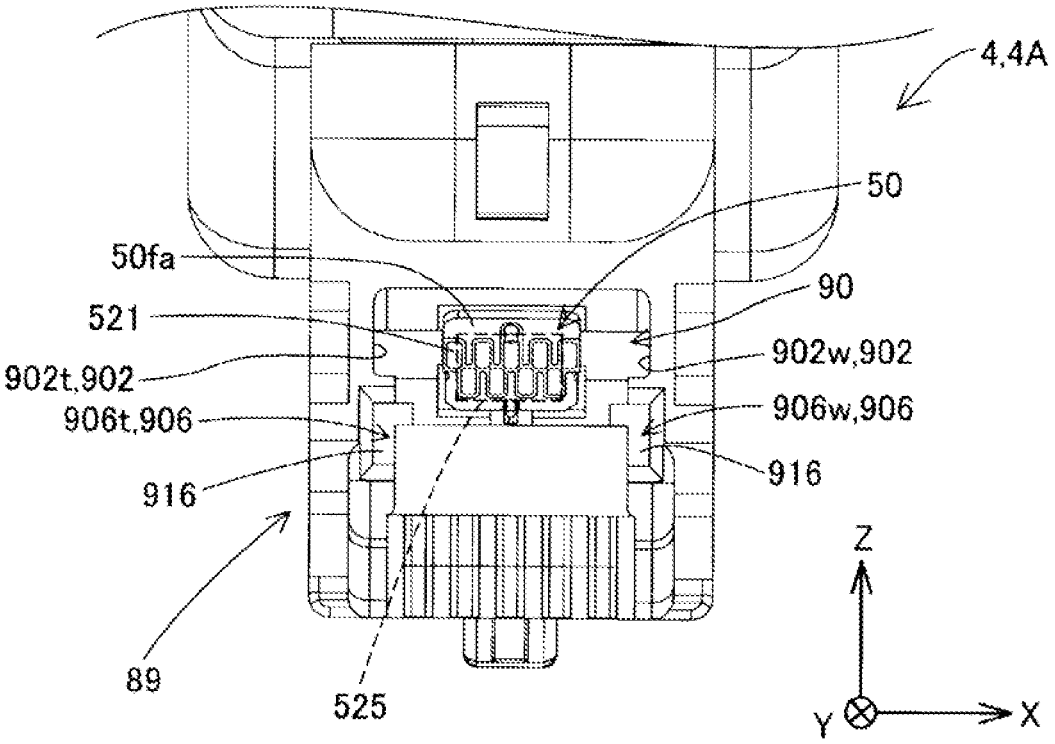
FIG. 13 is a first view illustrating a part of the first type of cartridge.
Figure 14:
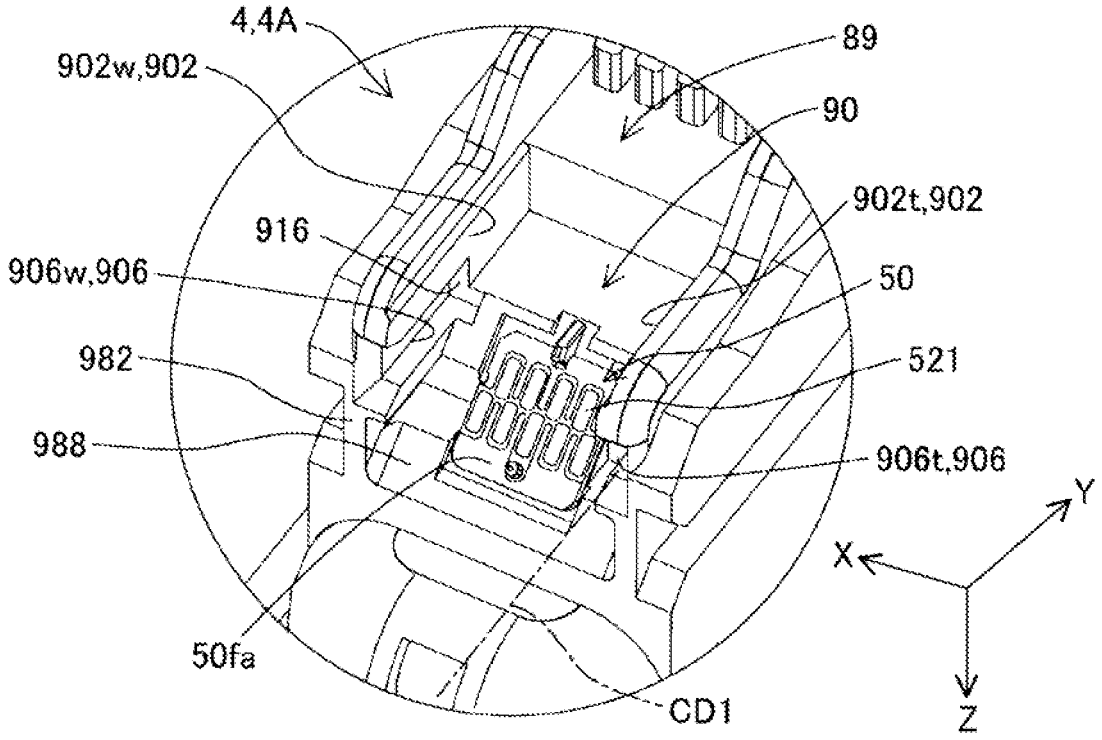
FIG. 14 is a second view illustrating a part of the first type of cartridge.
Figure 15:
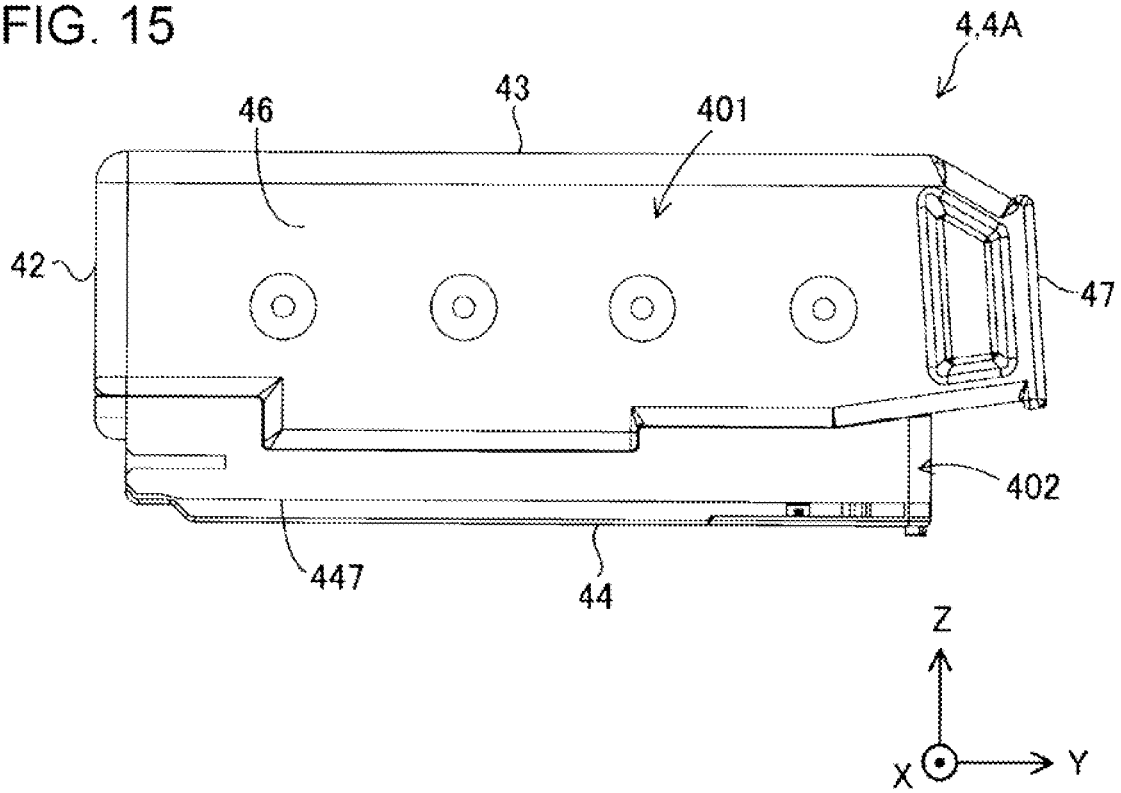
FIG. 15 is a first side view of the first type of cartridge.
Figure 16:
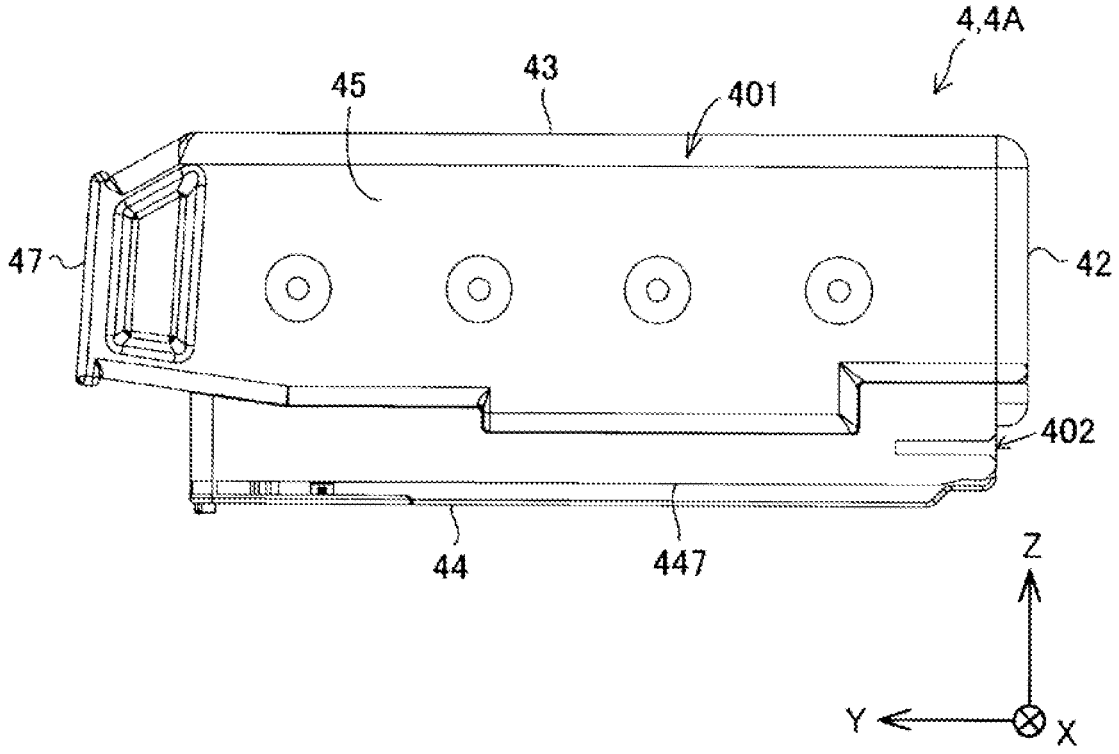
FIG. 16 is a second side view of the first type of cartridge.
Figure 17:
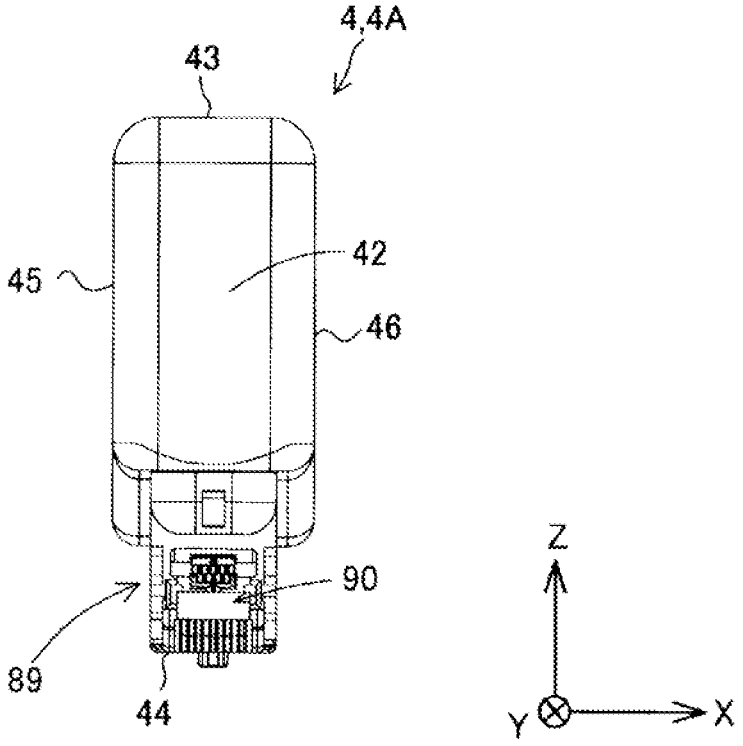
FIG. 17 is a front view of the first type of cartridge.
Figure 18:
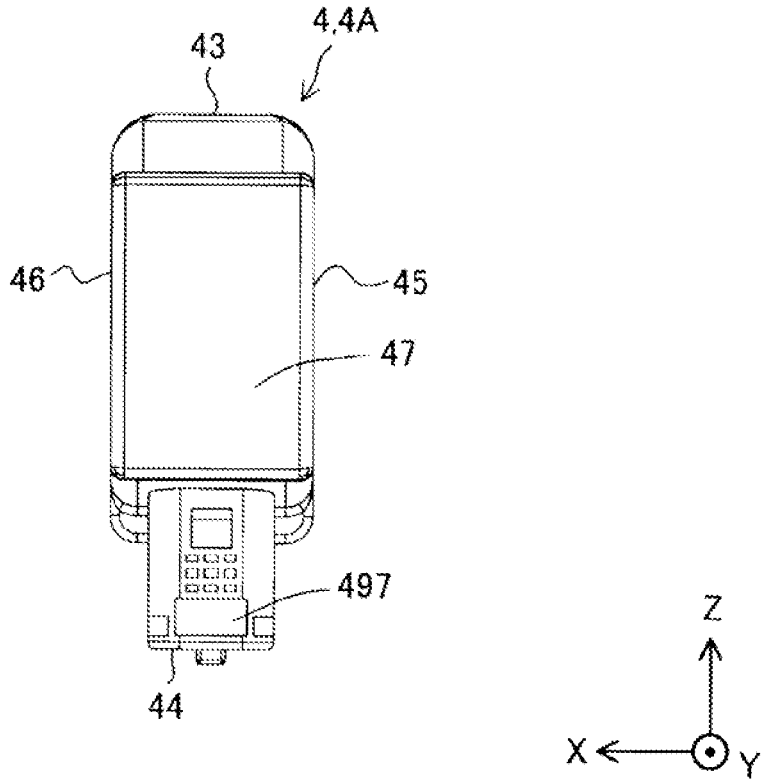
FIG. 18 is a rear view of the first type of cartridge.
Figure 19:
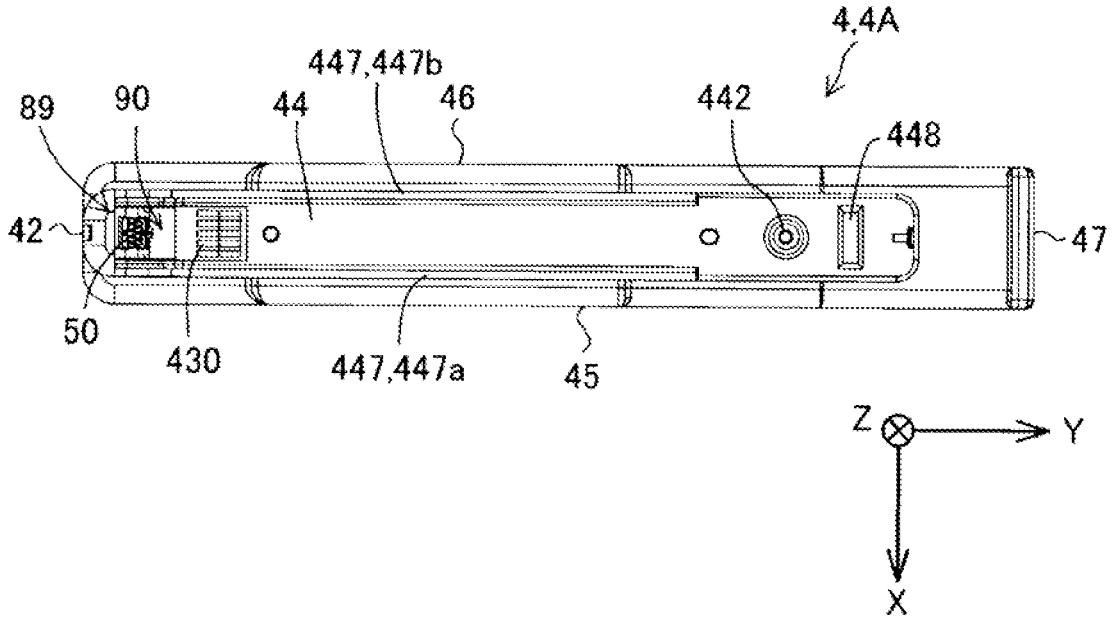
FIG. 19 is a top view of the first type of cartridge.

FIG. 11 is a perspective view of the first type of cartridge 4A. FIG. 12 is an exploded perspective view of the first type of cartridge 4A. FIG. 13 is a first view illustrating a part of the first type of cartridge 4A. FIG. 14 is a second view illustrating a part of the first type of cartridge 4A. FIG. 15 is a first side view of the first type of cartridge 4A. FIG. 16 is a second side view of the first type of cartridge 4A. FIG. 17 is a front view of the first type of cartridge 4A. FIG. 18 is a rear view of the first type of cartridge 4A. FIG. 19 is a top view of the first type of cartridge 4A. Regarding the cartridge 4, the Y direction is a depth direction, the Z direction is a height direction, and the X direction is a width direction. The cartridge 4 is a cartridge that contains a large amount of liquid and has a large outer shape. Regarding the outer shape of the cartridge 4, a dimension in the Y direction is the greatest, and a dimension in the Z direction and a dimension in the X direction are smaller in this order. In the drawings illustrating the cartridge 4, the X direction, the Y direction, and the Z direction are based on a completion state of the terminal coupling process, which is a state in which the insertion of the cartridge 4 into the cartridge mounting portion 6 has been completed. That is, in the drawings illustrating the cartridge 4, the X direction, the Y direction, and the Z direction are based on a state before the supply portion coupling process for rotationally moving the support member 610.

As illustrated in FIG. 11, the first type of cartridge 4A includes a liquid container 401 forming a top wall 43 and an adapter 402 forming a bottom wall 44. The adapter 402 is attached to the liquid container 401 by fitting. The liquid container 401 and the adapter 402 are formed of a synthetic resin. The liquid container 401 and the adapter 402 may be formed of the same material or may be formed of different materials. In addition, a member forming the liquid container 401 may be lighter than a member forming the adapter 402. By doing so, operability of the cartridge 4 is improved.

An outer shape of the first type of cartridge 4A is a substantially rectangular parallelepiped shape. The first type of cartridge 4A includes a main body 41 forming an outer shell and a circuit board 50 attached to the main body 41. The main body 41 is formed by the liquid container 401 and the adapter 402 described above. The main body 41 of the first type of cartridge 4A has a front wall 42, a rear wall 47, the top wall 43, the bottom wall 44, a first side wall 45, a second side wall 46, and a corner portion 89. Each wall 42, 43, 44, 45, 46, and 47 is also referred to as each surface 42, 43, 44, 45, 46, and 47. The front wall 42 and the rear wall 47 face each other in the Y direction along the insertion direction D1. The top wall 43 and the bottom wall 44 face each other in the Z direction. The Z direction is parallel to the central axis CA2 along an extending direction of the liquid supply portion 442. The first side wall 45 and the second side wall 46 face each other in the X direction. The X direction is a direction orthogonal to the Y direction and the Z direction. Here, the Y direction is also referred to as a first facing direction, and the Z direction is also referred to as a second facing direction.

As illustrated in FIG. 15, the front wall 42 is located on the insertion direction D1 side in which the cartridge 4 is inserted into the cartridge mounting portion 6. That is, the front wall 42 forms an insertion tip surface on the −Y direction side, which is the insertion direction D1 side. The rear wall 47 forms a surface on the +Y direction side, which is the removal direction. The top wall 43 is located on the +Z direction side and intersects the front wall 42 and the rear wall 47. As illustrated in FIG. 11, the bottom wall 44 is located on the −Z direction side, which is the gravity direction side in the mounted state, and forms a coupling tip surface in the coupling direction D2 illustrated in FIG. 3. That is, the bottom wall 44 is located on the coupling direction D2 side. The bottom wall 44 intersects the front wall 42 and the rear wall 47. An insertion opening 446 is formed in the bottom wall 44. The liquid supply portion 442 is arranged in the insertion opening 446. The liquid supply portion 442 is arranged so that the central axis CA2 of the liquid supply portion 442 passes through the insertion opening 446. In a mounting process of the cartridge 4, the liquid introduction portion 642 of the cartridge mounting portion 6 is inserted into the insertion opening 446. The insertion opening 446 and the liquid supply portion 442 are located in a region RY between a middle portion MP of the cartridge 4 and an end portion on the rear wall 47 side in the insertion direction D1.

As illustrated in FIG. 17, the first side wall 45 is located on the −X direction side, and the second side wall 46 is located on the +X direction side. Each of the first side wall 45 and the second side wall 46 intersects the front wall 42, the rear wall 47, the top wall 43, and the bottom wall 44. The corner portion 89 is provided at a corner portion where the front wall 42 and the bottom wall 44 intersect each other, and the circuit board 50 having the cartridge side terminal 521 is arranged at the corner portion 89. The corner portion 89 has a recess portion 90 recessed inward.

The first type of cartridge 4A further includes the liquid containing portion 450 containing a liquid, the liquid supply portion 442, a cartridge side identification member 430, the supply portion positioning portion 448, the circuit board 50, and a cartridge guide portion 447 that are illustrated in FIG. 11, and the cartridge engaging portion 497 illustrated in FIG. 18.

The liquid supply portion 442 illustrated in FIG. 12 communicates with the liquid containing portion 450 and has the central axis CA2. A direction along the central axis CA2 is the Z direction. The direction along the central axis CA2, which is the extending direction of the liquid supply portion 442, intersects the −Y direction, which is the insertion direction D1. That is, the liquid supply portion 442 extends in the direction intersecting the insertion direction D1, that is, in the Z direction in the present embodiment. The liquid supply portion 442 is a tubular member that protrudes from a container bottom wall 431, which is a bottom wall of the liquid container 401, toward the adapter 402. The liquid supply portion 442 is arranged in a recess-shaped supply portion arrangement chamber 461 of the adapter 402. The insertion opening 446 illustrated in FIG. 11 is formed at a recessed-shaped bottom portion of the supply portion arrangement chamber 461.

The liquid supply portion 442 has an internal flow path 449, and the liquid of the liquid containing portion 450 is made to flow to the liquid introduction portion 642, which is the outside. A supply base end portion 442*e*2, which is a base end portion of the liquid supply portion 442, is coupled to the container bottom wall 431, which is the bottom wall of the liquid container 401. A tip opening 442*e*1, which is a tip portion of the liquid supply portion 442, opens toward the outside. A valve mechanism (not illustrated) that opens/closes the internal flow path 449 is arranged in the internal flow path 449 of the liquid supply portion 442. The valve mechanism has a valve seat, a valve body, and an urging member sequentially arranged from the tip opening 442*e*1. The valve seat is an annular member formed of rubber or elastomer. The valve body is a columnar member and closes a valve hole formed in the valve seat. The urging member is a coil spring that urges the valve body toward the valve seat. In the mounted state of the cartridge 4, the liquid introduction portion 642 pushes the valve body in a direction away from the valve seat, so that the valve mechanism is opened.

The cartridge side identification member 430 illustrated in FIG. 11 is used to identify whether or not the cartridge 4 has been inserted into the correct slot 61C, 61M, 61Y, or 61K of the cartridge mounting portion 6. The cartridge side identification member 430 is a rib arranged on a side of the bottom wall 44 close to the front wall 42, that is, at a location adjacent to the corner portion 89 in the present embodiment. The cartridge side identification members 430 form different pattern shapes depending on colors of the liquids contained in the cartridges 4C, 4M, 4Y, and 4K. The pattern shape is determined by the number and locations of ribs.

The supply portion positioning portion 448 performs positioning by receiving the device side supply portion positioning portion 644 to regulate the movement of the liquid supply portion 442 with respect to the liquid introduction portion 642. Specifically, in the supply portion coupling process, the supply portion positioning portion 448 performs positioning of the liquid supply portion 442 with respect to the liquid introduction portion 642 by receiving the device side supply portion positioning portion 644 to regulate the movement of the supply portion positioning portion 448 in a direction intersecting the coupling direction D2. The supply portion positioning portion 448 is a recess portion formed in the bottom wall 44 and recessed from an outer surface of the bottom wall 44. A section of the supply portion positioning portion 448 has a rectangular shape. Note that in another embodiment, the supply portion positioning portion 448 may be a recess portion penetrating through the bottom wall 44. A second direction CD2, which is a direction in which the supply portion positioning portion 448 extends, is in the Z direction. In the present embodiment, the supply portion positioning portion 448 extends from the bottom wall 44 toward the top wall 43 in the +Z direction. In the present embodiment, the second direction CD2 is parallel to the second facing direction. The direction in which the supply portion positioning portion 448 extends is a direction along a direction in which the liquid introduction portion 642 is received. The supply portion positioning portion 448 is located in the region RY between the middle portion MP of the cartridge 4 and the end portion on the rear wall 47 side in the insertion direction D1.

The supply portion positioning portion 448 is a recess portion having a substantially rectangular parallelepiped shape. Regarding the supply portion positioning portion 448, an opening area of an entrance portion formed on an outer surface side of the bottom wall 44 is greater than an opening area on a bottom side of the recess portion, which is a side deeper than the entrance portion. As a result, in the supply portion coupling process, the supply portion positioning portion 448 can easily receive the device side supply portion positioning portion 644. The supply portion positioning portion 448 is located on an opposite side of the liquid supply portion 442 or the insertion opening 446 from the cartridge side terminal 521 of the circuit board 50 in the insertion direction D1. In the present embodiment, the supply portion positioning portion 448 is formed in the vicinity of the rear wall 47 in the bottom wall 44.

As illustrated in FIG. 18, the cartridge engaging portion 497 is provided in the rear wall 47. The cartridge engaging portion 497 is a recess portion recessed from an outer surface of the rear wall 47.

As illustrated in FIG. 13, the circuit board 50 is arranged at the corner portion 89. The circuit board 50 has a plurality of cartridge side terminals 521 arranged on a front surface 50*fa* and a storage device 525 arranged on a rear surface. The plurality of cartridge side terminals 521 that can be coupled to the device side terminals 721 by coming into contact with the device side terminals 721 are electrically coupled to the storage device 525 via wiring. The plurality of cartridge side terminals 521 (nine cartridge side terminals in the present embodiment) are provided. The circuit board 50 having the plurality of cartridge side terminals 521 is located on the insertion direction D1 side with respect to the liquid supply portion 442 in the insertion direction D1. The front surface 50*fa* on which the plurality of cartridge side terminals 521 are arranged is inclined with respect to the insertion direction D1. Specifically, the front surface 50*fa* is inclined with respect to the insertion direction D1 toward a direction including a −Z direction component and a −Y direction component. The storage device 525 stores information regarding the cartridge 4, for example, the date of manufacture or the remaining amount of liquid. In the mounted state, the plurality of cartridge side terminals 521 are electrically coupled to the corresponding device side terminals 721 by coming into contact with the corresponding device side terminals 721. As a result, the control portion 31 of the printing device 10 and the storage device 525 are electrically coupled to each other, so that data communication between the control portion 31 of the printing device 10 and the storage device 525 becomes possible.

As illustrated in FIG. 14, the circuit board 50 is arranged in the recess portion 90 of the corner portion 89. As illustrated in FIG. 11, the recess portion 90 is provided over the front wall 42 and the bottom wall 44. As illustrated in FIG. 14, the recess portion 90 has a recess portion front wall 982 forming an entrance opening located on the front wall 42 side, a recess portion bottom wall 988 forming a bottom portion of the recess portion 90, and a pair of recess portion side walls 902*t* and 902*w*.

The recess portion bottom wall 988 has a portion inclined with respect to the Y direction. In the present embodiment, the inclined portion is inclined with respect to the Y direction so as to be located on the +Z direction side toward the recess portion front wall 982. The circuit board 50 is arranged on this inclined portion.

The pair of recess portion side walls 902*t* and 902*w* are walls coupled to the recess portion bottom wall 988. The pair of recess portion side walls 902*t* and 902*w* face each other in the X direction. A first recess portion side wall 902*t* is coupled to a −X direction side end portion of the recess portion bottom wall 988. A second recess portion side wall 902*w* is coupled to a +X direction side end portion of the recess portion bottom wall 988. When the first recess portion side wall 902*t* and the second recess portion side wall 902*w* are used without distinction, the first recess portion side wall 902*t* and the second recess portion side wall 902*w* are referred to as a recess portion side wall 902. An entrance opening, which is an opening formed in the recess portion front wall 982, is an entrance when the device side terminal portion 70 is inserted into the recess portion 90.

The pair of recess portion side walls 902*t* and 902*w* are provided with a pair of terminal positioning portions 906*t* and 906*w*, respectively. The pair of terminal positioning portions 906*t* and 906*w* are provided so as to face each other in an X-axis direction. When the pair of terminal positioning portions 906*t* and 906*w* are used with distinction, the pair of terminal positioning portions 906*t* and 906*w* are also referred to as a first terminal positioning portion 906*t* and a second terminal positioning portion 906*w*, and when the pair of terminal positioning portions 906*t* and 906*w* are used without distinction, the pair of terminal positioning portions 906*t* and 906*w* are also referred to as a terminal positioning portion 906. The terminal positioning portion 906 is a groove formed in the recess portion side wall 902. The first terminal positioning portion 906*t* is a groove having a shape recessed from a surface of the first recess portion side wall 902*t*. The second terminal positioning portion 906*w* is a groove having a shape recessed from a surface of the second recess portion side wall 902*w*. Note that a shape of the terminal positioning portion 906 is not limited to the groove as long as the terminal positioning portion 906 can receive the device side terminal positioning portion 756. For example, in another embodiment, the terminal positioning portion 906 may be composed of two convex portions arranged at intervals in the Z direction. The device side terminal positioning portion 756 is received between the two convex portions.

A first direction CD1, which is a direction in which the terminal positioning portion 906 extends, is the Y direction along the insertion direction D1. In the present embodiment, as illustrated in FIG. 14, the terminal positioning portion 906 extends in the +Y direction from the recess portion front wall 982 toward the rear wall 47. The Y direction, which is the first direction CD1, intersects the Z direction, which is the second direction CD2 in which the supply portion positioning portion 448 extends, and is orthogonal to the Z direction in the present embodiment. In the present embodiment, the first direction CD1 is parallel to the first facing direction. The direction in which the terminal positioning portion 906 extends is a direction along a direction in which the device side terminal positioning portion 756 is received.

The first terminal positioning portion 906*t* receives the first device side terminal positioning portion 756*t* illustrated in FIG. 9 in the terminal coupling process. That is, the first device side terminal positioning portion 756*t* is inserted into the first terminal positioning portion 906*t*. The second terminal positioning portion 906*w* receives the second device side terminal positioning portion 756*w* illustrated in FIG. 9 in the terminal coupling process. That is, the second device side terminal positioning portion 756*w* is inserted into the second terminal positioning portion 906*t*. The insertion of the device side terminal positioning portion 756 into the terminal positioning portion 906 is performed after the fitting between the cartridge side identification member 430 and the device side identification member 630 has been started. In addition, the insertion of the device side terminal positioning portion 756 into the terminal positioning portion 906 is started before the contact between the device side terminal 721 and the cartridge side terminal 521 is started.

The device side terminal positioning portion 756 is received by the terminal positioning portion 906, so that the device side terminal positioning portion 756 and the terminal positioning portion 906 come into contact with each other. As a result, the movement of the cartridge side terminal 521 with respect to the device side terminal 721 in the Z direction and the X direction, which are the directions intersecting the insertion direction D1, is regulated. That is, the device side positioning portion 906 receives the device side terminal positioning portion 756, so that the relative movement of the cartridge side terminal 521 and the device side terminal 721 in a direction intersecting the first direction CD1, which is the direction along the insertion direction D1, is regulated. The movement is regulated, so that positioning of the cartridge side terminal 521 with respect to the device side terminal 721 in the Z direction and the X direction, which are the directions intersecting the insertion direction D1, is performed. The terminal positioning portion 906 has an end wall 916 on the +Y direction side. The cartridge 4 is further pushed toward the insertion direction D1 from an abutting location where a tip portion of the device side terminal positioning portion 756 abuts on the end wall 916, so that the terminal coupling process is completed. The cartridge 4 is further pushed toward the insertion direction D1 from the abutting location, so that the holding mechanism 73 is pushed toward the insertion direction D1. As a result, the device side terminal portion 70 moves toward the insertion direction D1 following the movement of the cartridge 4. In a state in which the terminal coupling process is completed, the urging member 780 illustrated in FIG. 4 is in a compressed state. In addition, in the state in which the terminal coupling process is completed, the device side terminal 721 and the cartridge side terminal 521 come into contact with each other.

As illustrated in FIGS. 11 and 19, the cartridge guide portions 447 extend along the −Y direction, which is the insertion direction D1. The cartridge guide portions 447 are guided in the insertion direction D1 by the device guide portions 602 of the cartridge mounting portion 6. The cartridge guide portions 447 are formed on the first side wall 45 and the second side wall 46, respectively. In FIG. 11, a single hatch is attached to the cartridge guide portion 447 formed on the first side wall 45. The cartridge guide portions 447 are formed on the first side wall 45 and the second side wall 46, respectively, by steps. That is, regarding a width of the cartridge 4, a part including the bottom wall 44 is smaller than the other part located away from the bottom wall 44 than a bottom wall side portion. As a result, the step forming the cartridge guide portion 447 is formed. The cartridge guide portion 447 is a surface facing the −Z direction. The cartridge guide portion 447 formed on the first side wall 45 is also referred to as a first cartridge guide portion 447*a*, and the cartridge guide portion 447 formed on the second side wall 46 is also referred to as a second cartridge guide portion 447*b*.

When the cartridge 4 is inserted into the cartridge mounting portion 6, a surface of the device guide portion 602 on the +Z direction side and the cartridge guide portion 447 come into contact with each other, so that the movement of the cartridge 4 in the insertion direction D1 is guided in a state in which a posture of the cartridge 4 is maintained. A surface of the first device guide portion 602*a* on the +Z direction side comes into contact with the first cartridge guide portion 447*a*, and a surface of the second device guide portion 602*b* on the +Z direction side comes into contact with the second cartridge guide portion 447*b*.

As illustrated in FIGS. 11 and 12, the adapter 402 includes the corner portion 89 having the terminal positioning portion 906 and the cartridge side terminal 521, the cartridge side identification member 430, the insertion opening 446, the supply portion positioning portion 448, the cartridge guide portion 447, the supply portion arrangement chamber 461.

Figure 20:
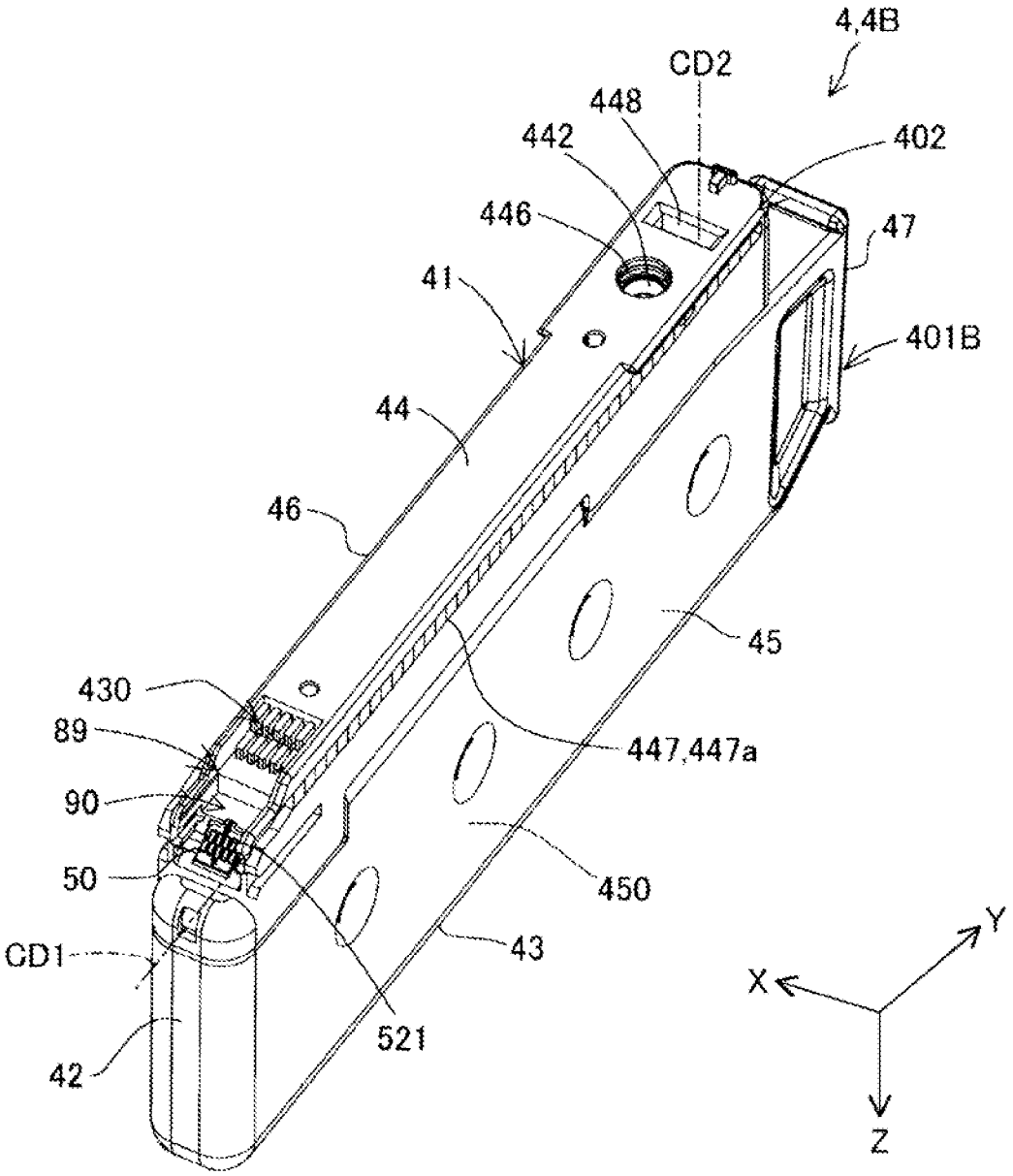
FIG. 20 is a perspective view of a second type of cartridge.
Figure 21:
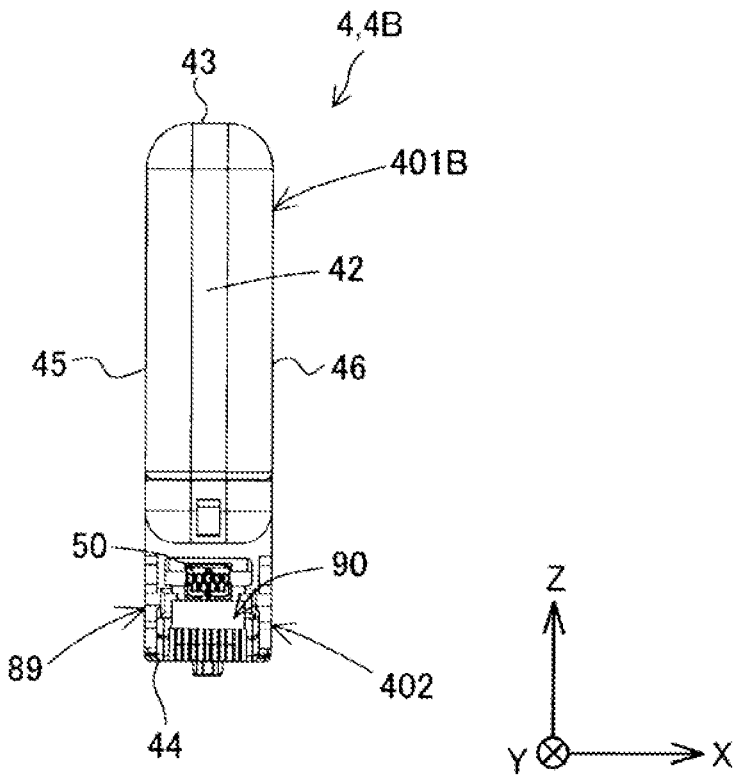
FIG. 21 is a front view of the second type of cartridge.
Figure 22:
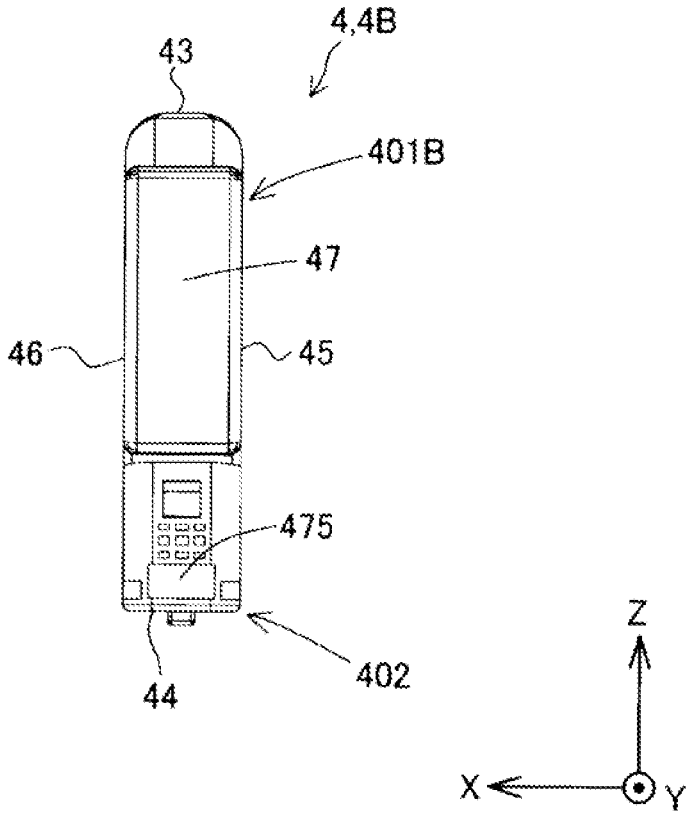
FIG. 22 is a rear view of the second type of cartridge.

FIG. 20 is a perspective view of the second type of cartridge 4B. FIG. 21 is a front view of the second type of cartridge 4B. FIG. 22 is a rear view of the second type of cartridge 4B. A difference between the second type of cartridge 4B and the first type of cartridge 4A is that a width of a liquid container 401B is smaller than that of the liquid container 401 illustrated in FIG. 11. As a result, an amount of liquid that can be contained in a liquid containing portion 450 formed in the liquid container 401B is smaller than an amount of liquid that can be contained in the liquid containing portion 450 formed in the liquid container 401. Since the other components of the second type of cartridge 4B are the same as those of the first type of cartridge 4A, the same components will be denoted by the same reference numerals, and a description thereof will be omitted.

An adapter 402 of the second type of cartridge 4B has the same configuration as the adapter 402 of the first type of cartridge 4A except for a pattern shape formed by a cartridge side identification member 430. As a result, the adapter 402 can be commonly used for the cartridges 4A and 4B having different capacities.

A-5. Mounting Process of Cartridge in Cartridge Mounting Portion

Figure 23:
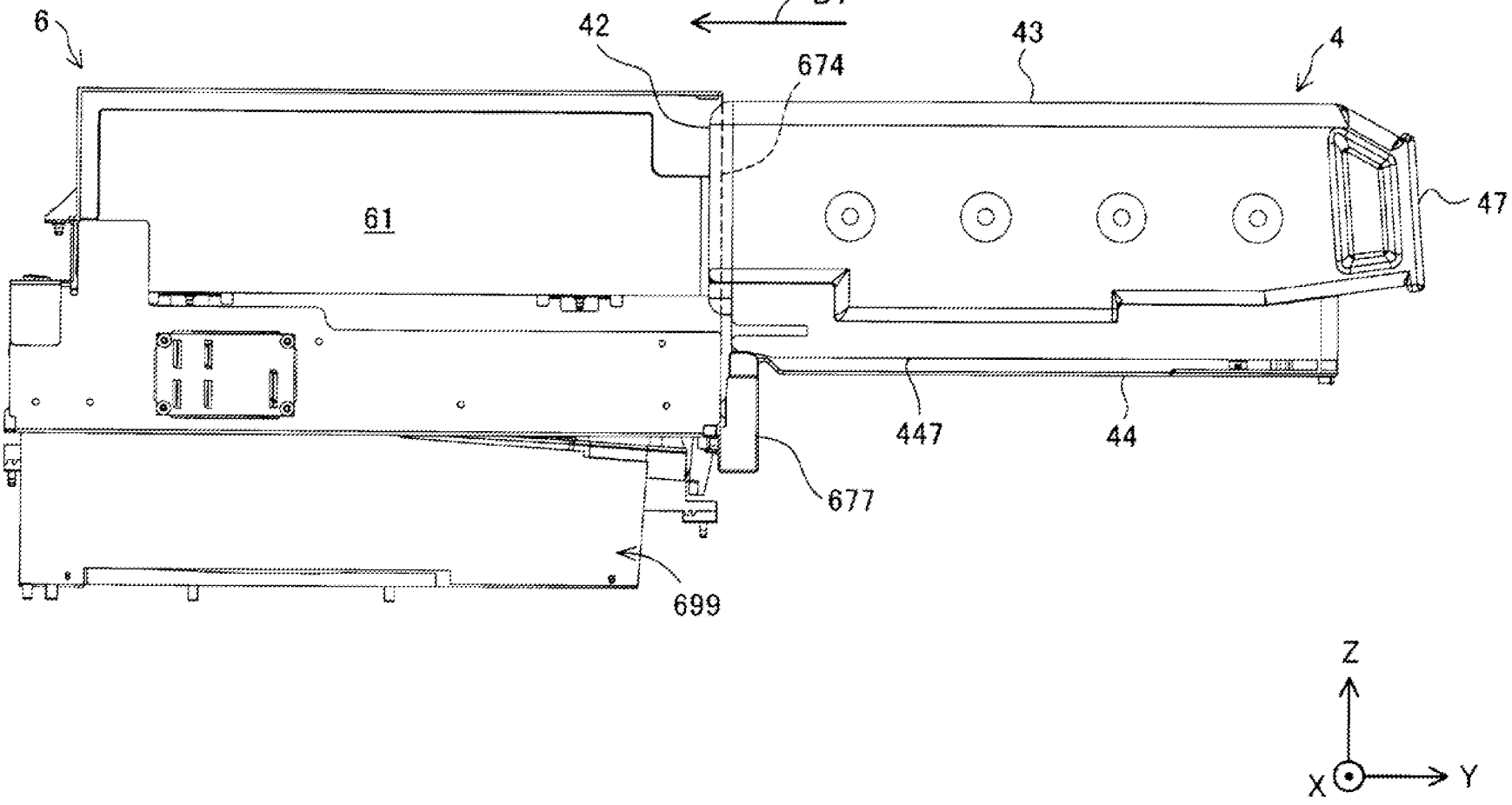
FIG. 23 is a first view for describing a mounting process.
Figure 24:
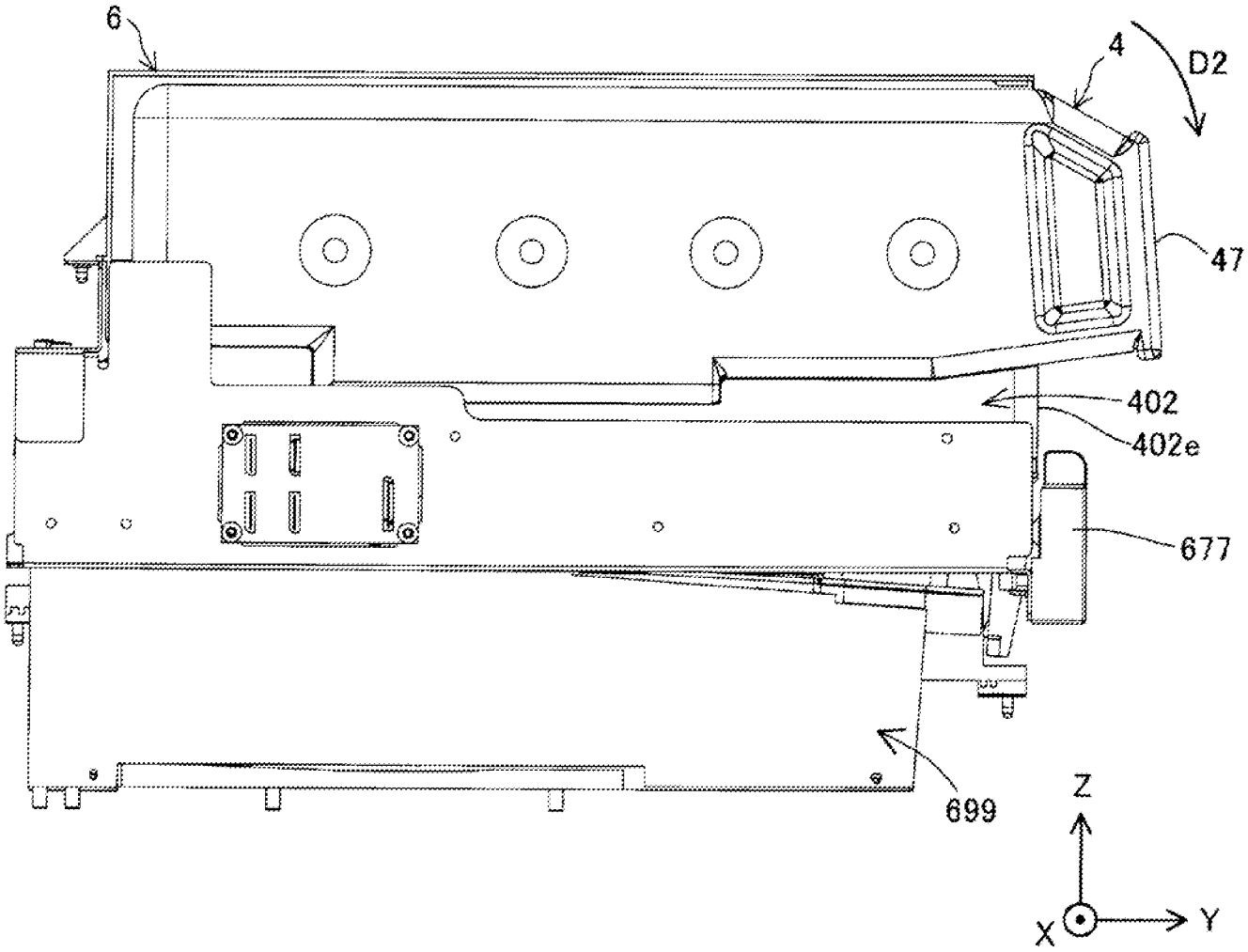
FIG. 24 is a second view for describing the mounting process.
Figure 25:
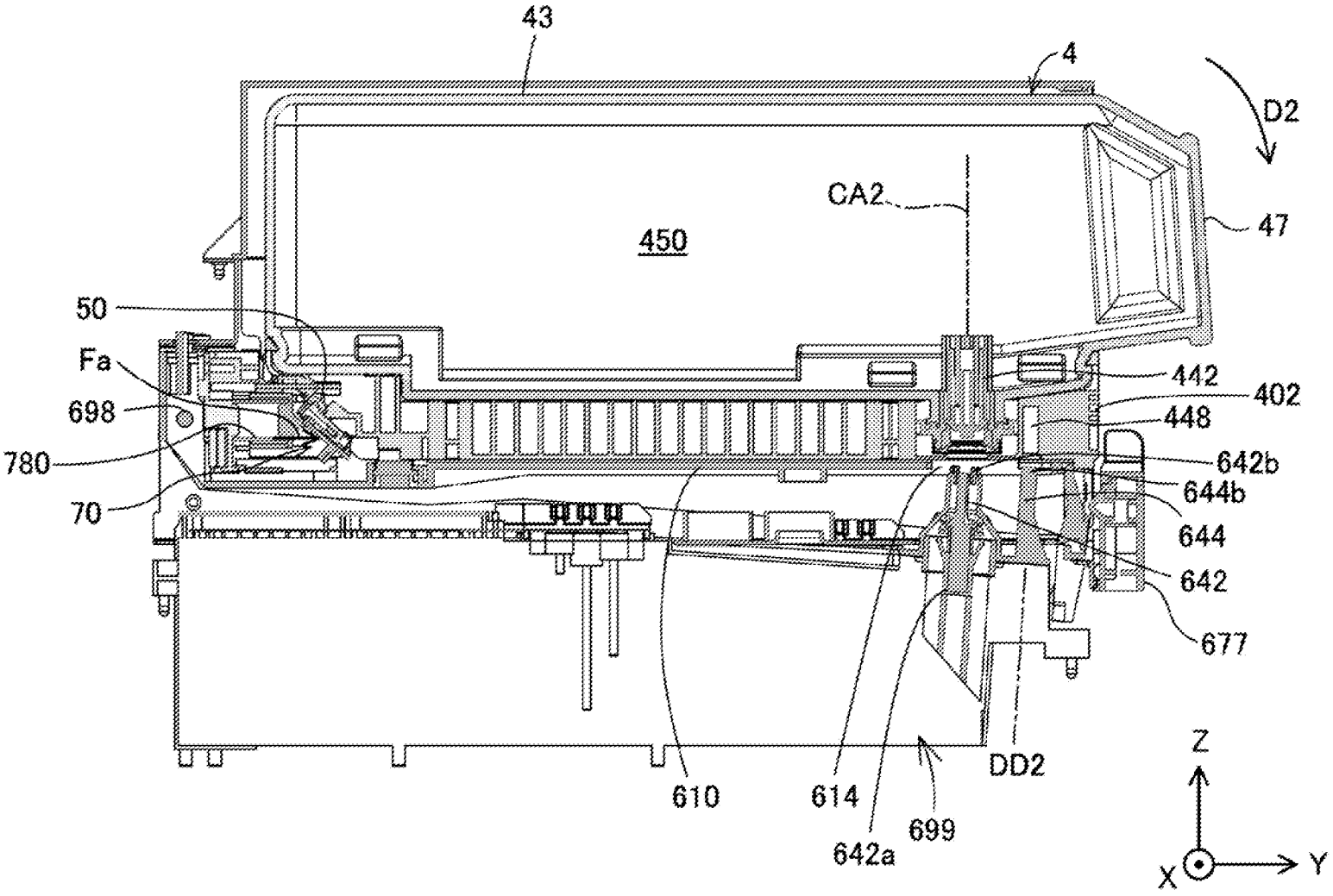
FIG. 25 is a sectional view of FIG. 24.

FIG. 23 is a first view for describing a mounting process. FIG. 24 is a second view for describing the mounting process. FIG. 25 is a sectional view of FIG. 24, and is a view corresponding to a section taken along line III-III of FIG. 2.

Figure 26:
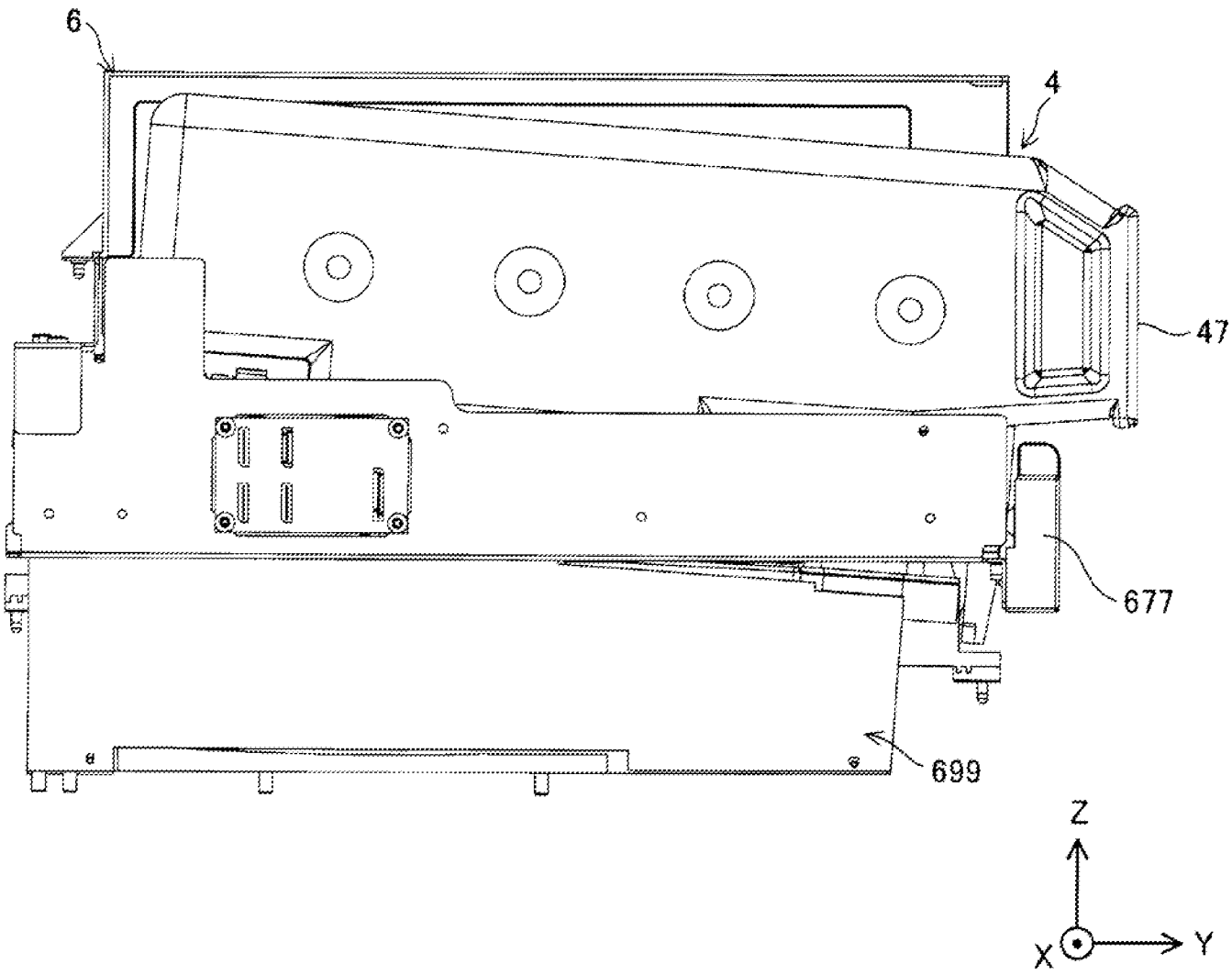
FIG. 26 is a third view for describing the mounting process.
Figure 27:
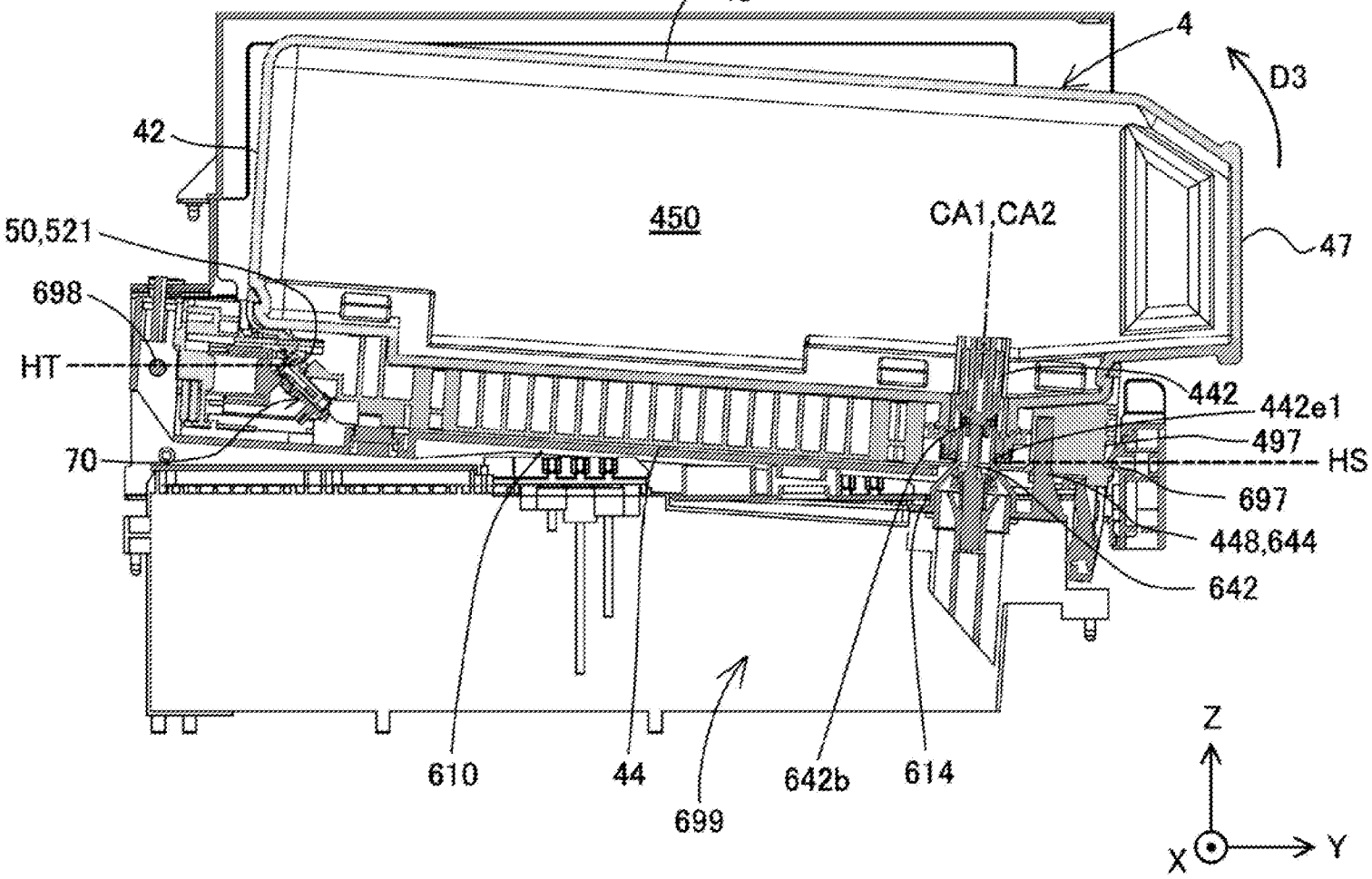
FIG. 27 is a sectional view of FIG. 26.

FIG. 26 is a third view for describing the mounting process. FIG. 27 is a sectional view of FIG. 26, and is a view corresponding to a section taken along line III-III of FIG. 2. FIGS. 23 to 25 illustrate the terminal coupling process, and FIGS. 26 and 27 illustrate the supply portion coupling process.

As illustrated in FIG. 23, when the cartridge 4 is mounted in the cartridge mounting portion 6, the cartridge 4 is first inserted from the insertion/removal opening 674 of the cartridge mounting portion 6 into the accommodation chamber 61. The insertion direction D1 of the cartridge 4 into the cartridge mounting portion 6 is the −Y direction, and is parallel to a direction in which the cartridge guide portion 447 extends.

When the cartridge 4 is further pushed in the insertion direction D1 from a state illustrated in FIG. 23, the terminal coupling process is completed as illustrated in FIG. 24. In the completed state of the terminal coupling process illustrated in FIG. 24, an end portion 402*e* of the adapter 402 on the +Y direction side is located on the insertion direction D1 side with respect to the engagement forming body 677. In addition, as illustrated in FIG. 25, in the completed state of the terminal coupling process, the cartridge side terminal 521 and the device side terminal 721 are in contact with each other. In addition, in the completed state of the terminal coupling process, the urging member 780 is compressed, and the device side terminal portion 70 receives an external force Fa from the urging member 780. A user executes the supply portion coupling process by rotationally moving the cartridge 4 in the coupling direction D2 with the rotation fulcrum 698 as the fulcrum while pushing the cartridge 4 toward the insertion direction D1.

When the cartridge 4 rotationally moves in the coupling direction D2, the reception of the device side supply portion positioning portion 644 by the supply portion positioning portion 448 is started before the coupling between the liquid introduction portion 642 and the liquid supply portion 442 is started. Thereafter, the positioning of the liquid supply portion 442 with respect to the liquid introduction portion 642 is started. That is, the movement of the liquid supply portion 442 intersecting the central axis CA2 of the liquid supply portion 442 is regulated. In the supply portion coupling process, when the device side supply portion positioning portion 644 is inserted into the liquid introduction portion 642, a case where the cartridge 4 moves minutely in the Y direction can occur. In this case, the urging member 780 expands and contracts, so that the device side terminal portion 70 moves so as to follow the movement of the cartridge side terminal 521. As a result, contact between the cartridge side terminal 521 and the device side terminal 721 can be maintained well.

As illustrated in FIG. 27, in the mounted state of the cartridge 4 in which the supply portion coupling process is completed, the cartridge side terminal 521 of the circuit board 50 and the device side terminal 721 of the device side terminal portion 70 come into contact with each other, so that the liquid supply portion 442 and the liquid introduction portion 642 are coupled to each other. In the mounted state, the insertion direction D1 of the cartridge 4 intersects the direction in which the liquid supply portion 442 extends. In addition, in the mounted state, the cartridge 4 is mounted in the cartridge mounting portion 6 so that the extending direction of the liquid supply portion 442 becomes a direction including a gravity direction component. As a result, the liquid in the liquid supply portion 442 can be made to smoothly flow. Therefore, an amount of liquid remaining in the liquid containing portion 450 without being consumed can be reduced. In the present embodiment, in the mounted state, the liquid supply portion 442 is inclined with respect to the gravity direction so that the direction in which the liquid supply portion 442 extends and the gravity direction form an angle in the range of greater than 0° and 15° or less. In the mounted state, the tip opening 442*e*1 is arranged at a location lower than the cartridge side terminal 521. That is, a height HS of the tip opening 442*e*1 with respect to a reference location, for example, an installation surface of the printing device 10, is lower than a height HT of the cartridge side terminal 521. As a result, even though the liquid is leaked from the tip opening 442*e*1 of the liquid supply portion 442, a possibility that the leaked liquid will adhere to the cartridge side terminal 521 can be reduced. As a result, the occurrence of a short circuit of the cartridge side terminal 521 or the occurrence of a coupling failure between the cartridge side terminal 521 and the device side terminal 721 can be suppressed. Note that the plurality of cartridge side terminals 521 are arranged, but a reference terminal is a cartridge side terminal 521 arranged at the lowest location.

In addition, in the mounted state, the mounted state of the cartridge 4 is maintained by engaging the mounting engaging portion 697 with the cartridge engaging portion 497. The user rotates the cartridge 4 in a decoupling direction D3, which is a direction opposite to the coupling direction D2 with the rotation fulcrum 698 as the fulcrum, by lifting the rear wall 47 side of the cartridge 4. As a result, the mounting engaging portion 697 is displaced by being pushed by the main body of the cartridge 4, so that the engagement between the mounting engaging portion 697 and the cartridge engaging portion 497 is released.

According to the above embodiment, the positioning of the cartridge side terminal 521 and the device side terminal 721 can be performed by the device side terminal positioning portion 756 and the terminal positioning portion 906, and the positioning of the liquid supply portion 442 and the liquid introduction portion 642 can be performed by the device side supply portion positioning portion 644 and the supply portion positioning portion 448. In addition, the first direction CD1 and the second direction CD2 intersect each other, so that the liquid supply portion 442 and the cartridge side terminal 521 do not need to be provided on the same wall of the cartridge 4, and a degree of freedom in arrangement of the liquid supply portion 442 and the cartridge side terminal 521 is thus improved. For example, as in the present embodiment, the liquid supply portion 442 can be provided at the bottom wall 44, and the cartridge side terminal 521 can be provided on a recess portion 90 configuring a wall different from the bottom wall 44. In addition, regarding the printing device 10, the device first direction DD1 in which the device side terminal positioning portion 756 extends and the device second direction DD2 in which the device side supply portion positioning portion 644 extends intersect each other. As a result, the liquid introduction portion 642 and the device side terminal 721 do not need to be provided on the same wall of the cartridge mounting portion 6, and a degree of freedom of arrangement is thus improved. In addition, the first direction CD1 and the second direction CD2 are not parallel to each other, but intersect each other, so that a regulation direction of the movement of the liquid supply portion 442 with respect to the liquid introduction portion 642 and a regulation direction of the movement of the cartridge side terminal 521 with respect to the device side terminal 721 have different direction components. That is, in the mounting process, components in the regulation direction of the movement of the cartridge side terminal 521 with respect to the device side terminal 721 are an X direction component and a Z direction component orthogonal to the Y direction. On the other hand, in the mounting process, the regulation direction of the movement of the liquid supply portion 442 with respect to the liquid introduction portion 642 includes at least an X direction component and a Y direction component.

In addition, according to the above embodiment, as illustrated in FIGS. 12 and 13, the terminal positioning portion 906 is a groove formed in the corner portion 89, and as illustrated in FIG. 20, the supply portion positioning portion 448 is a recess portion formed in the bottom wall 44. As a result, the terminal positioning portion 906 and the supply portion positioning portion 448 have a simple structure, and can thus be easily formed.

In addition, according to the above embodiment, as illustrated in FIG. 20, the supply portion positioning portion 448 is located on an opposite side of the liquid supply portion 442 from the cartridge side terminal 521 of the circuit board 50 in the −Y direction, which is the insertion direction D1. In addition, as illustrated in FIG. 25, the rotation fulcrum 698 is arranged on a side where the cartridge side terminal 521 is located. As a result, when the cartridge 4 is rotationally moved around the rotation fulcrum 698 to couple the liquid supply portion 442 and the liquid introduction portion 642 to each other, a distance between the rotation fulcrum 698 and the supply portion positioning portion 448 can be increased. By increasing the distance between the rotation fulcrum 698 and the supply portion positioning portion 448, a curve of a movement locus of the supply portion positioning portion 448 at the time of rotationally moving the cartridge 4 can be decreased, that is, a curvature of the movement locus can be decreased. That is, it is possible to make the movement locus of the supply portion positioning portion 448 closer to a straight line. As a result, the supply portion positioning portion 448 can easily receive the device side terminal positioning portion 642. In addition, as a result, even though a protruding length of the device side supply portion positioning portion 642 is increased, the device side supply portion positioning portion 642 can be smoothly received by the supply portion positioning portion 448. Therefore, the protruding length of the device side supply portion positioning portion 642 can be increased, and thus, the device side supply portion positioning portion 642 is received by the supply portion positioning portion 448 at an earlier stage of the supply portion coupling process. As a result, the positioning of the liquid supply portion 442 and the liquid introduction portion 642 can be performed more accurately.

In addition, according to the above embodiment, as illustrated in FIG. 11, the cartridge side terminal 521 is located on the insertion direction D1 side with respect to the liquid supply portion 442 in the insertion direction D1. That is, the cartridge side terminal 521 can be easily designed so that a coupling between the liquid supply portion 442 and the liquid introduction portion 642 is made after an electrical coupling between the cartridge side terminal 521 and the device side terminal 721 is made by contact between the cartridge side terminal 521 and the device side terminal 721. In addition, when the wrong type of cartridge 4 is inserted into the accommodation chamber 61, even though the cartridge side identification member 430 does not collide with the device side identification member 630, the electrical coupling between the cartridge side terminal 521 and the device side terminal 721 is made before the coupling between the liquid supply portion 442 and the liquid introduction portion 642. As a result, by exchanging data between the control portion 31 and the storage device 525 of the circuit board 50, the control portion 31 can determine that the wrong type of cartridge 4 is inserted. In this case, the control portion 31 can cause the user to stop executing the supply portion coupling process by displaying erroneous insertion information indicating that the wrong type of cartridge 4 has been inserted into the accommodation chamber 61 on a display portion (not illustrated) of the printing device 10 or a display portion of an external device such as a personal computer coupled to the printing device 10 so as to be capable of data communication with the printing device 10. Therefore, it is possible to reduce a possibility that a wrong type of liquid will be supplied from the liquid supply portion 442 to the liquid introduction portion 642.

According to the above embodiment, as illustrated in FIG. 27, the cartridge 4 has the liquid supply portion 442 arranged at the bottom wall 44 intersecting the front wall 42 located on the insertion direction D1 side. As a result, in the mounted state, the bottom wall 44 is located on the gravity direction side, and the liquid in the liquid containing portion 450 can thus be made to smoothly flow to the liquid supply portion 442. As a result, an amount of liquid remaining in the liquid containing portion 450 without being consumed can be reduced. In addition, as illustrated in FIG. 23, the insertion direction D1 of the cartridge 4 and the removal direction, which is a direction opposite to the insertion direction D1, are the Y direction and a direction along the horizontal direction. As a result, when the cartridge 4 is inserted into and removed from the cartridge mounting portion 6, the cartridge 4 is only required to be moved in the horizontal direction, and operability of the cartridge 4 can thus be improved. In particular, as in the present embodiment, the cartridge 4 having a large outer shape for accommodating a large amount of liquid can be inserted into and removed from the cartridge mounting portion 6 along the horizontal direction, and the operability of the cartridge 4 can thus be further improved. As described above, in the mounted state of the cartridge 4, the insertion direction D1 of the cartridge 4 and the extending direction of the liquid supply portion 442 intersect each other, so that the insertion direction D1 can be set to the horizontal direction and the extending direction can be set to a direction including a vertical direction component, and it is thus possible to reduce the amount of liquid remaining in the liquid containing portion 450 without being consumed while improving the operability of the cartridge 4.

In addition, according to the above embodiment, as illustrated in FIGS. 11 and 19, the cartridge 4 can be smoothly moved in the insertion direction D1 by including the cartridge guide portion 447. In particular, in the present embodiment, the outer shape of the cartridge 4 is the largest in the insertion direction D1. Therefore, the cartridge 4 has the cartridge guide portion 447 guided in the insertion direction D1, so that the cartridge 4 can be smoothly moved in the insertion direction D1. In addition, as illustrated in FIG. 19, the cartridge guide portion 447 includes the first cartridge guide portion 447*a* formed on the first side wall 45 and the second cartridge guide portion 447*b* formed on the second side wall 46 corresponding to the first side wall 45. As a result, the cartridge guide portions 447 can be provided on both sides of the cartridge 4 in the width direction, and an insertion posture of the cartridge 4 can thus be made stable when the cartridge 4 is moved in the insertion direction D1 with respect to the cartridge mounting portion 6.

In addition, according to the above embodiment, as illustrated in FIG. 11, the circuit board 50 having the cartridge side terminal 521 is arranged at the corner portion 89 where the front wall 42 and the bottom wall 44 intersect each other. As a result, by moving the cartridge 4 with respect to the accommodation chamber 61 of the cartridge mounting portion 6 in the insertion direction D1, the cartridge side terminal 521 and the device side terminal 721 can be easily brought into contact with each other. In particular, in the present embodiment, as illustrated in FIG. 14, the cartridge 4 has the terminal positioning portion 906 at the corner portion 89, so that the cartridge side terminal 521 and the device side terminal 721 can be reliably brought into contact with each other in the mounting process.

In addition, according to the above embodiment, as illustrated in FIG. 12, the cartridge 4 has the liquid container 401 and the adapter 402, and a degree of freedom in design can thus be improved. For example, a common adapter 402 can be used for a plurality of liquid containers 401 and 401B whose liquid containing portions 450 have different capacities. In addition, the cartridge 4 has the liquid container 401 and the adapter 402, so that the liquid container 401 can be removed from the adapter 402 and a new liquid container 401 can be attached to the adapter 402, after the liquid has been consumed. As a result, recyclability of the cartridge 4 is improved.

In addition, in the present embodiment, the adapter 402 that can be commonly used for different types of liquid containers 401 and 401B is provided with the terminal positioning portion 906, the supply portion positioning portion 448, the cartridge side identification member 430, or the cartridge engaging portion 497, which are elements cooperating with the cartridge mounting portion 6. As a result, even though the types of liquid containers 401 are different from each other, the same type of adapter 402 can be used, and a manufacturing cost of the cartridge 4 can thus be reduced. In addition, as a result, a structure of the liquid containers 401 and 401B may be simplified.

In addition, according to the above embodiment, as illustrated in FIGS. 24 to 27, after the cartridge 4 is inserted into the accommodation chamber 61 through the insertion/removal opening 674, the liquid introduction portion 642 and the liquid supply portion 442 can be coupled to each other by displacing the opening 614 toward the gravity direction to arrange the tip portion 642*b* of the liquid introduction portion 642 and the other end portion 644*b* of the device side supply portion positioning portion 644 in the accommodation chamber 61. As a result, in a process of inserting the cartridge 4 into the accommodation chamber 61, it is possible to prevent the cartridge 4 from colliding with the liquid introduction portion 642 and the device side supply portion positioning portion 644.

B. Other Embodiments

B-1. Other Embodiment 1

In the above embodiment, as illustrated in FIG. 23, the insertion direction D1 is parallel to the horizontal direction, but is not limited thereto. In another embodiment, the insertion direction D1 may be inclined with respect to the horizontal direction as long as the insertion direction D1 has a horizontal direction component. For example, the insertion direction D1 may be inclined within the range of greater than 0° and 15° or less with respect to the horizontal direction. In addition, in the above embodiment, in the mounted state of the cartridge 4, the central axis CA2 of the liquid supply portion 442 is inclined with respect to the gravity direction, but may also be a direction along the gravity direction.

B-2. Other Embodiment 2

In the above embodiment, as illustrated in FIGS. 25 to 27, the cartridge 4 rotationally moves around the rotation fulcrum 698 in the coupling direction D2, so that the liquid supply portion 442 and the liquid introduction portion 642 are coupled to each other, but is not limited thereto. For example, the cartridge 4 may be moved in the −Z direction by moving the entire support member 610 in the −Z direction, so that the liquid supply portion 442 and the liquid introduction portion 642 may be coupled to each other. That is, in the terminal coupling process, the support member 610 may move in the −Z direction, which is the gravity direction, to displace the opening 614 in the −Z direction, which is the gravity direction, so that the tip portion 642*b* of the liquid introduction portion 642 may be arranged in the accommodation chamber 61 through the opening 614. In addition, a location of the support member 610 may be fixed, and the liquid introduction portion 642 may move to be coupled to the liquid supply portion 442.

B-3. Other Embodiment 3

In the above embodiment, as illustrated in FIG. 12, the liquid container 401 and the adapter 402 are separate bodies, but may be integrated with each other.

B-4. Other Embodiment 4

The present disclosure is not limited to an ink jet printer and an ink cartridge thereof, but can be applied to any printing device that ejects a liquid other than ink, and a cartridge thereof. For example, the present disclosure can be applied to the following various printing devices and cartridges thereof.

(1) Image recording device such as facsimile machine
(2) Printing device that ejects color material used for manufacturing color filter for image display device such as liquid crystal display
(3) Printing device that ejects electrode material used for forming electrode such as organic electroluminescence (EL) display or field emission display (FED)
(4) Printing device that ejects liquid containing bioorganic substance used for manufacturing biochip
(5) Sample printing device as precision pipette
(6) Printing device of lubricating oil
(7) Printing device of resin liquid
(8) Printing device that ejects lubricating oil onto precision machine such as watch or camera in pinpoint manner
(9) Printing device that ejects transparent resin liquid such as ultraviolet curable resin liquid onto substrate in order to form microhemispherical lens (optical lens) or the like used for optical communication element or the like
(10) Printing device that ejects acidic or alkaline etchant in order to etch substrate or the like
(11) Printing device including liquid ejecting head that ejects other arbitrary minute amounts of droplets Note that the "droplet" refers to a state of the liquid discharged from the printing device, and includes those leaving a trail in a granular shape, a tear shape, or a thread shape. In addition, the "liquid" mentioned here may be any material that can be ejected by the printing device. For example, the "liquid" may be a material in a state when a substance is in a liquid phase, and materials in a liquid state in which viscosity is high or low and materials in a liquid state such as sol, gel water, other inorganic solvents, organic solvents, solutions, liquid resins, and liquid metals are also included in the "liquid". In addition, not only a liquid as one state of a substance, but also a liquid in which particles of a functional material formed of a solid substance such as a pigment or a metal particle are dissolved, dispersed, or mixed in a solvent is included in the "liquid". In addition, typical examples of the liquid can include the ink as described in the above embodiment, liquid crystal, or the like. Here, the ink includes general water-based inks, oil-based inks, and various liquid compositions such as gel inks and hot melt inks.

C. Other Aspects

The present disclosure is not limited to the above-described embodiment, and can be realized by various configurations without deviating from the spirit thereof. For example, technical features of an embodiment corresponding to technical features in each of aspects described below can be appropriately replaced or combined in order to solve some or all of the problems described above or achieve some or all of the effects described above. In addition, when the technical feature is not described as essential in the present specification, the technical feature can be appropriately deleted.

(1) According to a first aspect of the present disclosure, there is provided a cartridge detachably mounted in a cartridge mounting portion of a printing device including a liquid introduction portion that receives a liquid, a device side terminal, a device side terminal positioning portion, and a device side supply portion positioning portion. The cartridge includes a cartridge side terminal that is electrically coupled to the device side terminal, a liquid supply portion that is coupled to the liquid introduction portion and that makes the liquid flow to the liquid introduction portion, a terminal positioning portion that performs positioning by receiving the device side terminal positioning portion to regulate movement of the cartridge side terminal with respect to the device side terminal, and a supply portion positioning portion that performs positioning by receiving the device side supply portion positioning portion to regulate movement of the liquid supply portion with respect to the liquid introduction portion. A first direction is a direction intersecting a second direction, the first direction being a direction in which the terminal positioning portion extends, the second direction being a direction in which the supply portion positioning portion extends. According to this aspect, positioning of the cartridge side terminal and the device side terminal can be performed by the terminal positioning portion, and positioning of the liquid supply portion and the liquid introduction portion can be performed by the supply portion positioning portion. As a result, it is possible to reduce a possibility that locations of the cartridge side terminal and the device side terminal or locations of the liquid supply portion and the liquid introduction portion will be deviated from each other. In addition, the first direction and the second direction intersect each other, so that the liquid supply portion and the cartridge side terminal do not need to be provided on the same wall of the cartridge, and a degree of freedom in arrangement of the liquid supply portion and the cartridge side terminal is thus improved.

(2) In the above aspect, the cartridge may further include a front wall located on a side of an insertion direction in which the cartridge is inserted into the cartridge mounting portion, a rear wall that faces the front wall in a first facing direction along the insertion direction, a bottom wall at which the liquid supply portion is arranged, a top wall facing the bottom wall in a second facing direction intersecting the first facing direction, and a corner portion where the front wall and the bottom wall intersect each other and where the cartridge side terminal is arranged. The first direction may be parallel to the first facing direction, and the second direction may be parallel to the second facing direction. According to this aspect, positioning of the cartridge side terminal and the device side terminal can be performed by the terminal positioning portion extending in the first direction parallel to the first facing direction, and positioning of the liquid supply portion and the liquid introduction portion can be performed by the supply portion positioning portion extending in the second direction parallel to the second facing direction.

(3) In the above aspect, the terminal positioning portion may be a groove formed in the corner portion, and the supply portion positioning portion may be a recess portion formed in the bottom wall. According to this aspect, the terminal positioning portion and the supply portion positioning portion can be easily formed.

(4) In the above aspect, the supply portion positioning portion may be located on an opposite side of the liquid supply portion from the cartridge side terminal in the insertion direction. According to this aspect, when the cartridge is rotationally moved with a side of the cartridge side terminal as a rotation fulcrum to couple the liquid supply portion and the liquid introduction portion to each other, a distance between the rotation fulcrum and the supply portion positioning portion can be increased. By increasing the distance between the rotation fulcrum and the supply portion positioning portion, a curvature of a movement locus of the supply portion positioning portion at the time of rotationally moving the cartridge can be decreased. As a result, the supply portion positioning portion can easily receive the device side terminal positioning portion.

(5) In the above aspect, the cartridge may further include a cartridge guide portion that extends along an insertion direction in which the cartridge is inserted into the cartridge mounting portion and that is guided in the insertion direction by the cartridge mounting portion. According to this aspect, the cartridge can be smoothly moved in the insertion direction by the cartridge guide portion.

(6) In the above aspect, in a mounted state that the cartridge is mounted in the cartridge mounting portion, a tip opening of the liquid supply portion may be arranged at a location lower than a location of the cartridge side terminal. According to this aspect, even though the liquid is leaked from the tip opening of the liquid supply portion, a possibility that the leaked liquid will adhere to the cartridge side terminal can be reduced.

(7) In the above aspect, in an insertion direction in which the cartridge is inserted into the cartridge mounting portion, the cartridge side terminal may be located on a side of the insertion direction with respect to the liquid supply portion. According to this aspect, the cartridge side terminal can be easily designed so that a coupling between the liquid supply portion and the liquid introduction portion is made after an electrical coupling between the cartridge side terminal and the device side terminal is made.

(8) According to a second aspect of the present disclosure, there is provided a printing system. The printing system includes a printing device that includes a cartridge mounting portion; and the cartridge according to the above aspect. According to this aspect, positioning of the cartridge side terminal and the device side terminal can be performed by the terminal positioning portion, and positioning of the liquid supply portion and the liquid introduction portion can be performed by the supply portion positioning portion. As a result, it is possible to reduce a possibility that locations of the cartridge side terminal and the device side terminal or locations of the liquid supply portion and the liquid introduction portion will be deviated from each other. In addition, the first direction and the second direction intersect each other, so that the liquid supply portion and the cartridge side terminal do not need to be provided on the same wall of the cartridge, and a degree of freedom in arrangement of the liquid supply portion and the cartridge side terminal is thus improved.

(9) According to a third aspect of the present disclosure, there is provided a printing device mounted with a cartridge including a cartridge side terminal, a liquid supply portion, a terminal positioning portion, and a supply portion positioning portion. The printing device includes a cartridge mounting portion that forms an accommodation chamber accommodating the cartridge and that has a support member supporting the cartridge. The cartridge mounting portion includes a liquid introduction portion coupled to the liquid supply portion, a device side terminal electrically coupled to the cartridge side terminal, a device side terminal positioning portion that performs positioning by being received by the terminal positioning portion to regulate movement of the cartridge side terminal with respect to the device side terminal, and a device side supply portion positioning portion that performs positioning by being received by the supply portion positioning portion to regulate movement of the liquid supply portion with respect to the liquid introduction portion, and a device first direction is a direction intersecting a device second direction, the device first direction being a direction in which the device side terminal positioning portion extends, the device second direction being a direction in which the device side supply portion positioning portion extends. According to this aspect, positioning of the cartridge side terminal and the device side terminal can be performed by the device side terminal positioning portion, and positioning of the liquid supply portion and the liquid introduction portion can be performed by the device side supply portion positioning portion. As a result, it is possible to reduce a possibility that locations of the cartridge side terminal and the device side terminal or locations of the liquid supply portion and the liquid introduction portion will be deviated from each other. In addition, the device first direction and the device second direction intersect each other, so that the liquid introduction portion and the device side terminal do not need to be provided on the same wall of the cartridge mounting portion, and a degree of freedom in arrangement of the liquid supply portion and the device side terminal is thus improved.

(10) In the above aspect, the printing device may further include a first device wall that has an insertion/removal opening which is an entrance/exit of the accommodation chamber, a device bottom wall that is formed by the support member, that has an opening, and that intersects the first device wall, and a displacement mechanism that displaces, by the support member being moved, the opening toward a gravity direction such that a tip portion of the liquid introduction portion and a tip portion of the device side supply portion positioning portion are arranged in the accommodation chamber through the opening. The liquid introduction portion and the device side supply portion positioning portion may be located on an opposite side of the support member from the accommodation chamber. According to the present embodiment, the device side terminal positioning portion and the device side supply portion positioning portion are located on the opposite side of the support member from the accommodation chamber, so that it is possible to prevent the liquid introduction portion and the device side supply portion positioning portion from colliding with the cartridge when the cartridge is inserted into the accommodation chamber.

The present disclosure can be realized in an aspect such a method of manufacturing a cartridge and a mechanism that mounts a cartridge in a cartridge mounting portion, in addition to the above aspects.

What is claimed is:

1. A cartridge detachably mounted in a cartridge mounting portion of a printing device including a liquid introduction portion that receives a liquid, a device side terminal, a device side terminal positioning portion, and a device side supply portion positioning portion, comprising:

a cartridge side terminal electrically coupled to the device side terminal;

a liquid supply portion that is coupled to the liquid introduction portion and that makes the liquid flow to the liquid introduction portion;

a terminal positioning portion that performs positioning by receiving the device side terminal positioning portion to regulate movement of the cartridge side terminal with respect to the device side terminal; and a supply portion positioning portion that performs positioning by receiving the device side supply portion positioning portion to regulate movement of the liquid supply portion with respect to the liquid introduction portion, wherein a first direction, in which the cartridge is attached to or detached from the cartridge mounting portion, is a direction intersecting a second direction, in which the liquid introduction portion is inserted into the liquid supply portion, the first direction being a direction in which the terminal positioning portion extends, the second direction being a direction in which the supply portion positioning portion extends.

2. The cartridge according to claim 1, further comprising:

a front wall located on a side of an insertion direction in which the cartridge is inserted into the cartridge mounting portion;

a rear wall that faces the front wall in a first facing direction along the insertion direction;

a bottom wall at which the liquid supply portion is arranged;

a top wall facing the bottom wall in a second facing direction intersecting the first facing direction; and a corner portion where the front wall intersects the bottom wall and where the cartridge side terminal is arranged, wherein the first direction is parallel to the first facing direction, and the second direction is parallel to the second facing direction.

3. The cartridge according to claim 2, wherein the terminal positioning portion is a groove formed in the corner portion, and the supply portion positioning portion is a recess portion formed in the bottom wall.

4. The cartridge according to claim 3, wherein the supply portion positioning portion is located on an opposite side of the liquid supply portion from the cartridge side terminal in the insertion direction.

5. The cartridge according to claim 1, further comprising:

a cartridge guide portion that extends along an insertion direction in which the cartridge is inserted into the cartridge mounting portion and that is guided in the insertion direction by the cartridge mounting portion.

6. The cartridge according to claim 1, wherein in a mounted state that the cartridge is mounted in the cartridge mounting portion, a tip opening of the liquid supply portion is arranged at a location lower than a location of the cartridge side terminal.

7. The cartridge according to claim 1, wherein in an insertion direction in which the cartridge is inserted into the cartridge mounting portion, the cartridge side terminal is located on a side of the insertion direction with respect to the liquid supply portion.

8. A printing system comprising:

a printing device that includes a cartridge mounting portion; and the cartridge according to claim 1.

9. A printing device mounted with a cartridge including a cartridge side terminal, a liquid supply portion, a terminal positioning portion, and a supply portion positioning portion, comprising:

a cartridge mounting portion that forms an accommodation chamber accommodating the cartridge and that has a support member supporting the cartridge, wherein the cartridge mounting portion includes a liquid introduction portion coupled to the liquid supply portion, a device side terminal electrically coupled to the cartridge side terminal, a device side terminal positioning portion that performs positioning by being received by the terminal positioning portion to regulate movement of the cartridge side terminal with respect to the device side terminal, and a device side supply portion positioning portion that performs positioning by being received by the supply portion positioning portion to regulate movement of the liquid supply portion with respect to the liquid introduction portion, and a device first direction, in which the cartridge is attached to or detached from the cartridge mounting portion, is a direction intersecting a device second direction, in which the liquid introduction portion is inserted into the liquid supply portion, the device first direction being a direction in which the device side terminal positioning portion extends, the device second direction being a direction in which the device side supply portion positioning portion extends.

10. The printing device according to claim 9, further comprising:

a first device wall that has an insertion/removal opening which is an entrance/exit of the accommodation chamber;

a device bottom wall that is formed by the support member, that has an opening, and that intersects the first device wall; and a displacement mechanism that displaces, by the support member being moved, the opening toward a gravity direction such that a tip portion of the liquid introduction portion and a tip portion of the device side supply portion positioning portion are arranged in the accommodation chamber through the opening, wherein the liquid introduction portion and the device side supply portion positioning portion are located on an opposite side of the support member from the accommodation chamber.

* * * * *